US007632082B2

(12) United States Patent
Ogasawara et al.

(10) Patent No.: US 7,632,082 B2
(45) **Date of Patent: *Dec. 15, 2009**

(54) HERMETICALLY SEALED COMPRESSOR AND METHOD OF MANUFACTURING THE SAME

(75) Inventors: Hirotsugu Ogasawara, Gunma (JP); Takahiro Nishikawa, Gunma (JP); Yoshihisa Kogure, Gunma (JP); Masayuki Hara, Gunma (JP); Hiroyuki Sawabe, Gunma (JP); Yoshiaki Hiruma, Gunma (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/972,731

(22) Filed: Jan. 11, 2008

(65) Prior Publication Data

US 2008/0112831 A1 May 15, 2008

Related U.S. Application Data

(62) Division of application No. 11/378,753, filed on Mar. 16, 2006, now Pat. No. 7,473,081.

(30) Foreign Application Priority Data

| | | |
|---|---|---|
| Mar. 17, 2005 | (JP) | 2005-076284 |
| Mar. 17, 2005 | (JP) | 2005-077277 |
| Mar. 31, 2005 | (JP) | 2005-101230 |
| Mar. 31, 2005 | (JP) | 2005-101231 |

(51) Int. Cl.
*F03C 2/00* (2006.01)
*F03C 4/00* (2006.01)
*F04C 2/00* (2006.01)

(52) U.S. Cl. ..... 418/99; 418/11; 418/60; 418/88; 418/94; 418/102; 184/6.18

(58) Field of Classification Search ..... 418/11, 418/60, 63, 88, 94, 102, DIG. 1, 270; 184/6.16–6.18
See application file for complete search history.

(56) References Cited

U.S. PATENT DOCUMENTS

| | | | | |
|---|---|---|---|---|
| 2,669,384 A | | 2/1954 | Dills | |
| 2,883,101 A | * | 4/1959 | Kosfeld | 418/94 |
| 4,355,963 A | * | 10/1982 | Tanaka et al. | 418/88 |
| 4,640,669 A | * | 2/1987 | Gannaway | 418/63 |
| 5,545,021 A | * | 8/1996 | Fukuoka et al. | 418/63 |

(Continued)

FOREIGN PATENT DOCUMENTS

| | | | | |
|---|---|---|---|---|
| JP | 57173589 A | * | 10/1982 | 418/87 |

(Continued)

*Primary Examiner*—Theresa Trieu
(74) *Attorney, Agent, or Firm*—Darby & Darby P.C.

(57) ABSTRACT

In a hermetically sealed compressor 100 including a rotary compressing element (4) having at least one cylinder (43A, 43B), and a roller (45) provided to the cylinder so as to be freely eccentrically rotatable, an electrically-driven element (2) for driving the roller (45) and a hermetically sealed container in which the rotary compressing element and the electrically-driven element are accommodated, oil (8) being stocked in the hermetically sealed container (1), the oil (8) in the hermetically sealed container (1) is injected into the compression chamber (43) when refrigerant is sucked into the compression chamber (43) of the cylinder.

7 Claims, 21 Drawing Sheets

U.S. PATENT DOCUMENTS

| | | | | |
|---|---|---|---|---|
| 5,678,657 | A | 10/1997 | Lee | |
| 6,171,090 | B1 * | 1/2001 | Hurley | 418/94 |
| 6,210,130 | B1 * | 4/2001 | Kakuda et al. | 417/363 |
| 6,336,799 | B1 | 1/2002 | Matsumoto et al. | |

FOREIGN PATENT DOCUMENTS

| | | | | |
|---|---|---|---|---|
| JP | 03246392 | A * | 11/1991 | 418/60 |
| JP | 6-323276 | A | 11/1994 | |
| JP | 2005-076527 | A | 3/2005 | |

* cited by examiner

HERMETICALLY SEALED COMPRESSOR AND METHOD OF MANUFACTURING THE SAME

CROSS-REFERENCE TO PRIOR APPLICATIONS

This is a divisional application of U.S. application Ser. No. 11/378,753, filed Mar. 16, 2006 which claims the benefit of Japanese Patent Application No. 2005-76284, filed Mar. 17, 2005, Japanese Patent Application No. 2005-101230, filed Mar. 31, 2005, Japanese Patent Application No. 2005-101231, filed Mar. 31, 2005, and Japanese Patent Application No. 2005-77277, filed Mar. 17, 2005, all of which are incorporated by reference herein in their entirety.

BACKGROUND OF THE INVENTION

1. Field of the Invention

The present invention relates to a hermetically sealed compressor used for refrigerating or air-conditioning operation, and particularly to a technique of enhancing COP (Coefficient Of Performance: refrigeration power/input power) of a hermetically sealed compressor.

2. Description of the Related Art

There is known a hermetically sealed rotary compressor including an electrically-driven element and a rotary compression element driven by the electrically-driven element to compress refrigerant that are accommodated in a hermetically sealed container. This type of hermetically sealed rotary compressor is disclosed in JP-A-6-323276, for example. According to this hermetically sealed rotary compressor, an eccentrically rotating roller is disposed in a cylinder so as to keep predetermined clearance from the inner surface of the cylinder and form a crescent-shaped space (so-called compression chamber) in the cylinder. Furthermore, a vane is provided so as to come into sliding contact with the roller, and the crescent-shaped space is partitioned to a refrigerant-sucking low-pressure chamber side and a refrigerant-compressing high pressure chamber side by the vane in terms of pressure.

However, the conventional hermetically sealed rotary compressor has a problem that the sealing performance of the crescent-shaped space is not sufficient, resulting in reduction of the cooling efficiency of the hermetically sealed rotary compressor.

SUMMARY OF THE INVENTION

The present invention has been implemented in view of the foregoing situation, and has an object to provide a hermetically sealed compressor in which the sealing performance between a roller and a cylinder is enhanced and thus the cooling efficiency can be enhanced.

Furthermore, the present invention has another object to provide a manufacturing method suitably used to manufacture a hermetically sealed compressor in which the sealing performance between a roller and a cylinder is enhanced and thus the cooling efficiency can be enhanced.

In order to attain the above objects, according to a first aspect of the present invention, there is provided a hermetically sealed compressor for compressing refrigerant, comprising: a rotary compressing element including at least one cylinder having a compression chamber for compressing the refrigerant and a roller that is provided in the cylinder so as to be freely eccentrically rotatable; an electrically-driven element for driving the roller; and a hermetically sealed container for accommodating the rotary compressing element and the electrically-driven element therein, oil being stocked in the hermetically sealed container, wherein the oil stocked in the hermetically sealed container is injected into the compression chamber when the refrigerant is sucked into the compression chamber in the cylinder.

The above hermetically sealed compressor may be further equipped with an oil supply device for supplying the oil stocked in the hermetically sealed container to a rubbing place between the electrically-driven element and the rotary compressing element, and an oil path for leading the oil supplied from the oil supply device to the compression chamber in connection with the suction of the refrigerant into the compression chamber of the cylinder.

The hermetically sealed compressor may be further equipped with an oil stocking portion that is disposed at the rubbing portion to stock the oil supplied from the oil supply device and supplies the oil to the oil path.

The hermetically sealed compressor may be further equipped with a bearing member that is disposed in the hermetically sealed container to support the cylinder, and supports a rotating shaft extending from the electrically-driven element, wherein the oil path has a through hole penetrating through the bearing member so as to extend from the rotational shaft side to the outer peripheral surface of the bearing member, and when the bearing member is welded and fixed to the hermetically sealed container from the outside of the hermetically sealed container, an opening end of the through hole at the outer peripheral surface side of the bearing member is closed by the welded portion.

The hermetically sealed compressor may be further equipped with a primary bearing member and a secondary bearing member that sandwich the cylinder therebetween and support a rotating shaft extending from the electrically-driven element, and an oil path for leading oil stocked in the hermetically sealed container to the compression chamber, wherein the oil path comprises a groove formed within at least one of the contact face between cylinder and the primary bearing member and the contact face between the cylinder and the secondary bearing member, and the oil stocked in the hermetically sealed container is led through the oil path to the compression chamber in connection with the suction of the refrigerant into the compression chamber of the cylinder.

In the above hermetically sealed compressor, the groove may be formed at the cylinder side.

In the hermetically sealed compressor, the rotary compressing element may have two cylinders.

The hermetically sealed compressor may be equipped with a plate-shaped member sandwiched by the two cylinders, and an oil path for leading oil stocked in the hermetically sealed container to the compression chamber, wherein the oil path comprises a groove formed within the contact face between at least one of the cylinders and the plate-shaped plate, and the oil stocked in the hermetically sealed container is led through the oil path to the compression chamber in connection with the suction of the refrigerant into the compression chamber of the cylinder.

In the hermetically sealed compressor, the cross-section area of the oil path may be determined so that the ratio between the cross-section area of the oil path and the displacement volume of the compression chamber is within a predetermined range.

The hermetically sealed compressor may be further equipped with a fit-in piece that is loosely fitted in a passage of the oil path, wherein the amount of the oil to be injected into the compression chamber is adjustable on the basis of the size of the clearance between the passage of the oil path and the fit-in piece.

In the hermetically sealed container, the oil path may comprise a secondary oil path for leading the oil supplied to the rubbing place to at least one of the upper and lower surfaces of the cylinder, a vertical hole penetrating through the cylinder in the vertical direction and intercommunicating with the secondary oil path, and an injection port that intercommunicates with the vertical hole and is opened to the inner surface of the cylinder, and the fit-in piece is loosely fitted in the vertical hole.

In the hermetically sealed compressor, the size of the clearance may be determined on the basis of the displacement volume of the compression chamber.

According to a second aspect of the present invention, there is provided a method of manufacturing a hermetically sealed compressor including an electrically-driven element having a rotating shaft, a rotary compressing element driven by the rotating shaft of the electrically-driven element, and a hermetically sealed container for accommodating the electrically-driven element and the rotary compressing element therein, comprising the steps of: forming a through hole in a bearing member disposed in the hermetically sealed container so as to support the cylinder and support the rotating shaft extending from the electrically-driven element so that the through hole penetrates through the bearing member so as to extend from the rotating shaft side to the outer peripheral surface of the bearing member, and forming an oil path for leading the oil supplied to a rubbing place between the electrically-driven element and the rotary compressing element to the compression chamber when the refrigerant is sucked into the compression chamber of the cylinder; positioning an opening end of the through hole at the outer peripheral surface side of the bearing member to the position corresponding to a place to be welded when the bearing member is inserted in the hermetically sealed container, welded from the outside of the hermetically sealed container and fixed to the hermetically sealed container, and then inserting the bearing member into the hermetically sealed container while gripping the bearing member; and welding the place to be welded from the outside of the hermetically sealed container to close the opening end.

The above hermetically sealed compressor manufacturing method may further comprise a step of providing a positioning member for positioning the opening end of the through hole at the outer peripheral surface side to the position corresponding to the welding place.

DETAILED DESCRIPTION OF THE PREFERRED EMBODIMENTS

Preferred embodiments according to the present invention will be described hereunder with reference to the accompanying drawings.

First Embodiment

Figure 1:
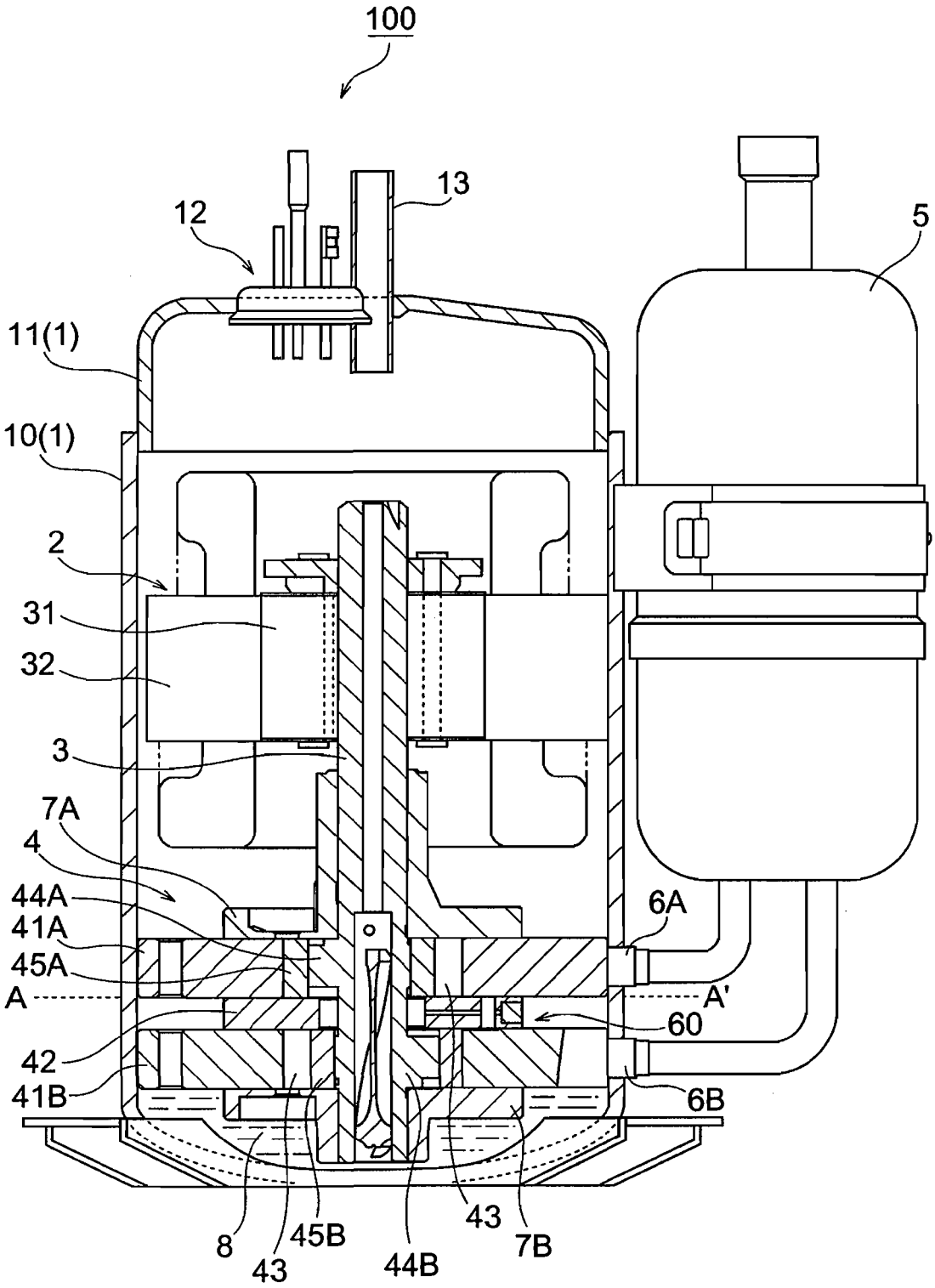
FIG. 1 is a longitudinally-sectional view showing the construction of a hermetically sealed rotary compressor according to a first embodiment of the present invention.
Figure 2:
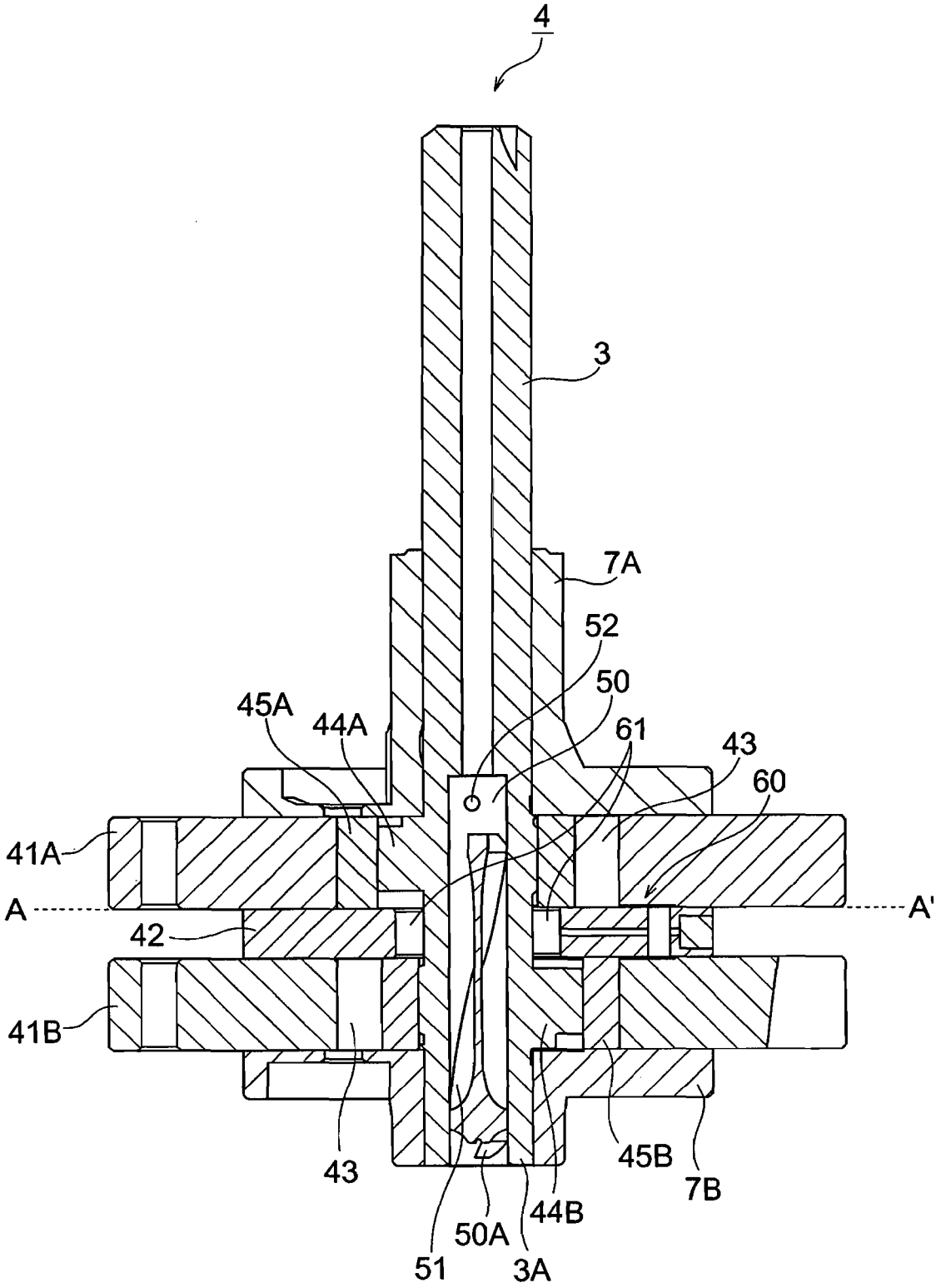
FIG. 2 is an enlarged longitudinally-sectional view of a rotary compressing element.

FIG. 1 is a longitudinally-sectional view showing a hermetically sealed rotary compressor according to a first embodiment of the present invention, and FIG. 2 is an enlarged longitudinally-sectional view of a rotary compressing element. The hermetically sealed rotary compressor 100 constructs a refrigerating unit by connecting a condenser for refrigerant and an evaporator for refrigerant through a pipe. As shown in FIG. 1, the hermetically sealed rotary compressor 100 has a hermetically sealed container 1, an electrically-driven element 2 accommodated at the upper side of the hermetically sealed container 1, and a rotary compressing element 4 accommodated at the lower side of the hermetically sealed container 1. The rotary compressing element 4 is driven by a crank shaft 3 of the electrically-driven element 2 to compress refrigerant.

The hermetically sealed container 1 is equipped with a cylindrical shell portion 10, and an end cap 11 fixed to the shell portion 10 by arc welding or the like, and the end cap 11 is provided with a terminal 12 serving as a relay terminal when power is supplied to the electrically-driven element 2, and a discharge pipe 13 for discharging compressed refrigerant to the outside of the compressor 100. Furthermore, suction pipes 6A, 6B for leading refrigerant from an accumulator 5 to the rotary compressing element 4 are fixed to the neighborhood of the bottom portion of the shell portion 10 by welding, for example.

The electrically-driven element 2 comprises a DC motor such as a so-called DC brushless motor or the like, and it is equipped with a rotor 31 and a stator 32 fixed to the shell portion 10. The crank shaft 3 is fixed to the rotor 31, and the crank shaft 3 is freely rotatably mounted to a primary bearing 7A and an secondary bearing 7B equipped to the rotary compressing element 4 so that the rotating force of the rotor 31 is transmitted to the rotary compressing element 4.

As shown in FIGS. 1 and 2, the rotary compressing element 4 has two cylinders 41A and 41B each having a cylindrical shape, and the cylinders 41A and 41B are disposed in the vertical direction between the primary bearing 7A and the secondary bearing 7B so as to sandwich a partition plate 42 therebetween. The upper-side opening face of the cylinder 41A at the upper stage is closed by the primary bearing 7A, and the lower-side opening face thereof is closed by the partition plate 42 to thereby form a compression chamber 43 in the cylinder. Likewise, the lower-side opening face of the cylinder 41B at the lower stage is closed by the secondary bearing 7B and the upper-side opening face thereof is closed by the partition plate 42 to thereby form a compression chamber 43 in the cylinder 41B.

Upper and lower eccentric portions 44A and 44B which are formed integrally with the crank shaft 3 so as to have a phase difference of about 180 degrees therebetween are fitted in the compression chambers 43, and rollers 45A and 45B which eccentrically rotate integrally with the rotation of the crank shaft 3 are provided in the respective compression chambers 43.

In the following description, the two cylinders 41A and 41B have substantially the same structure, and thus the cylinder 41A at the upper stage will be mainly described.

Figure 3:
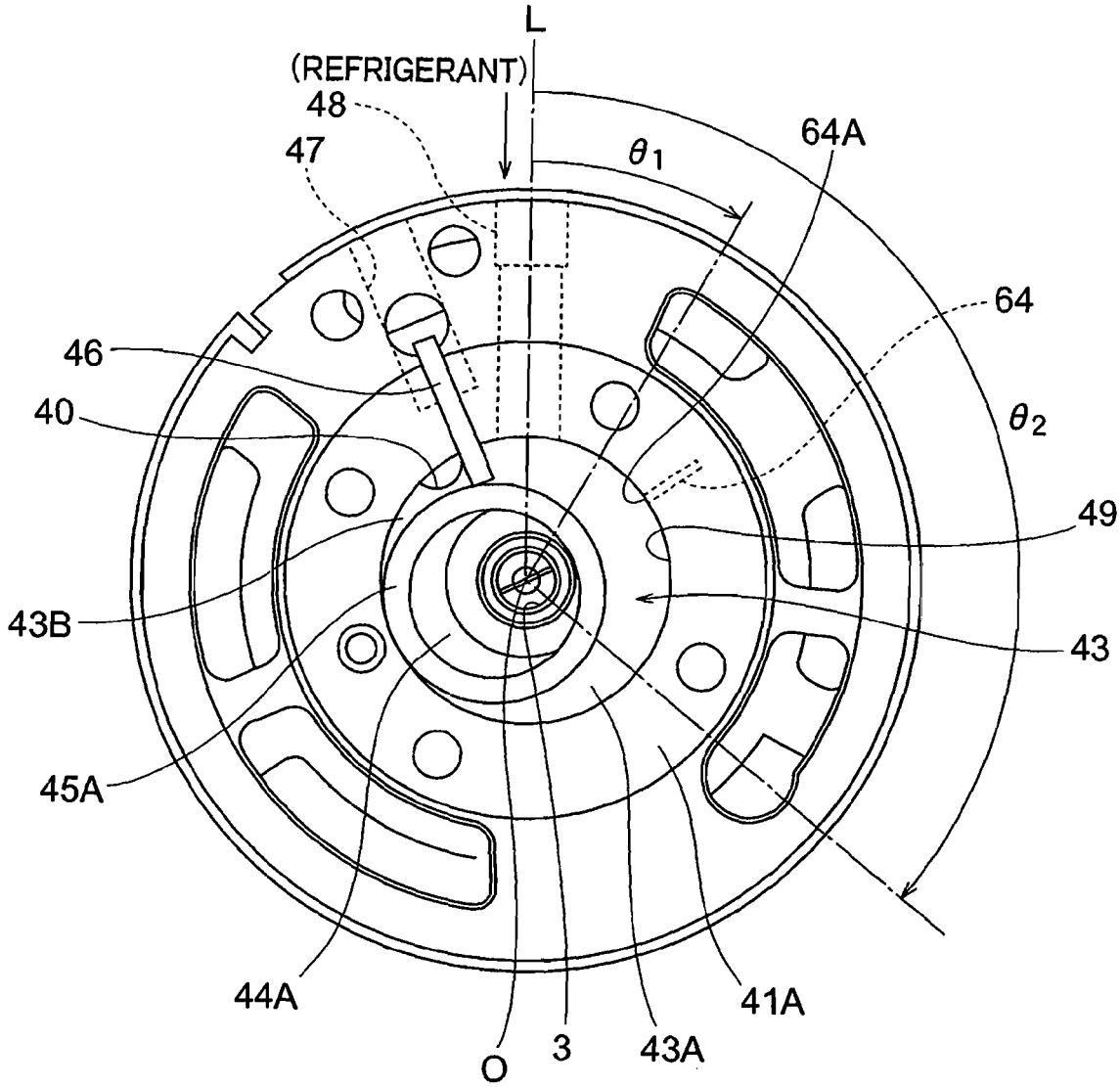
FIG. 3 is a plan view showing the construction of a cylinder.

FIG. 3 is a plan view showing the cylinder 41A. As shown in FIG. 3, a refrigerant suction port 48 and a refrigerant discharge port 40 are formed in the cylinder 41A. A vane groove 47 extending in the radial direction of the cylinder 41 A is provided between the suction port 48 and the discharge port 40, and a vane 46 is provided in the vane groove 47 so as to be freely slidable. The vane 46 is urged to be pressed against the roller 45A by an urging member such as a spring or the like at all times. When the roller 45A is eccentrically rotated, the vane 46 reciprocates in the vane groove 47 while coming into sliding contact with the outer peripheral surface of the roller 45A, and it serves to partition the inside of the compression chamber 43 into a low-pressure chamber side 43A and a high-pressure chamber side 43B in terms of pressure.

More specifically, the cylindrical space in the cylinder 41, that is, the compression chamber 43 for refrigerant is constructed in a crescent-shape because the roller 45A is eccentrically disposed in the cylinder 41. The contact of the vane 46 with the peripheral surface of the roller 45A partitions the crescent-shaped compression chamber 43 into the low-pressure chamber side 43A at the refrigerant suction port 48 side and the high-pressure chamber side 43B at the refrigerant discharge port 40 side.

As shown in FIG. 1, suction pipes 6A, 6B are engagedly inserted in the suction ports 48 of the cylinders 41A, 41*b* respectively, and the discharge port 40 shown in FIG. 3 is provided with a discharge valve. When the refrigerant pressure of the high-pressure chamber side 43B reaches a discharge pressure regulated by the discharge valve, the refrigerant is discharged from the discharge port 40 into the hermetically sealed container 1.

That is, in the hermetically sealed rotary compressor 100, the electrically-driven element 2 rotates the crank shaft 3, so that the rollers 45A and 45B are eccentrically rotated in the compression chamber 43. Accordingly, the refrigerant supplied from the outside of the compressor through the accumulator 5 is sucked through the suction pipe 6A, 6B into the lower pressure chamber side 43A of the compression chamber 43. The refrigerant thus sucked is compressed while fed to the high-pressure chamber side 43B, discharged from the discharge port 40 into the hermetically sealed container 1 and then discharged from the discharge pipe 13 to the outside of the compressor.

As shown in FIGS. 1 and 2, oil 8 is stocked at the bottom portion of the hermetically sealed container 1 until the lower surface of the cylinder 41A at the upper stage (indicated by a line A-A' in FIGS. 1 and 2. The lower end portion 3A of the crank shaft 3 is provided with an oil pickup 50 serving as an oil supply device for supplying the oil 8 to the primary bearing 7A, the secondary bearing 7B, the rubbing portion between the rotary compressing element 4 and the crank shaft 3 and the sliding portion of the rotary compressing element 4.

Specifically describing, the crank shaft 3 is designed in a cylindrical shape, and a cylindrical oil pickup 50 is pressed in the lower end portion 3A of the crank shaft 3. As shown in FIG. 2, a paddle 51 constituting a spiral oil flow path is integrally formed in the oil pickup 50. When the crank shaft 3 is rotated, the oil 8 stocked in the hermetically sealed container 1 is sucked up from the lower end 50A of the oil pickup 50 by centrifugal force in connection with the rotation of the paddle 51, passed through an oil supply hole 52 formed at the upper end side of the oil pickup 50 and then supplied as lubricating oil to the primary bearing 7A, the secondary bearing 7B and each rubbing portion between the rotary compressing element 4 and the crank shaft 3.

In order to prevent the abrasion between the roller 45A (45B) and the cylinder 41A (41B) when the roller 45A (45B) is eccentrically rotated, the roller 45A (45B) is designed so that predetermined clearance is kept between the roller 45A (45B) and the inner surface 49 of the cylinder 41A (41B) at the contact place therebetween. However, this clearance degrades the sealing performance of the compression chamber 43, particularly the sealing performance between the low-pressure chamber side 43A and the high-pressure chamber side 43B, and the cooling efficiency would be reduced unless any countermeasure is taken.

Therefore, the hermetically sealed rotary compressor 100 of this embodiment is equipped with an oil injecting portion 60 for injecting the oil 8 stocked in the hermetically sealed container 1 into the compression chamber 43 when the refrigerant is sucked into the low-pressure chamber 43A of the compression chamber 43. By injecting the oil 8 into the compressing chamber 43, oil film is formed between the roller 45A (45B) and the cylinder 41A (41B) to thereby enhance the sealing performance.

Figure 4:
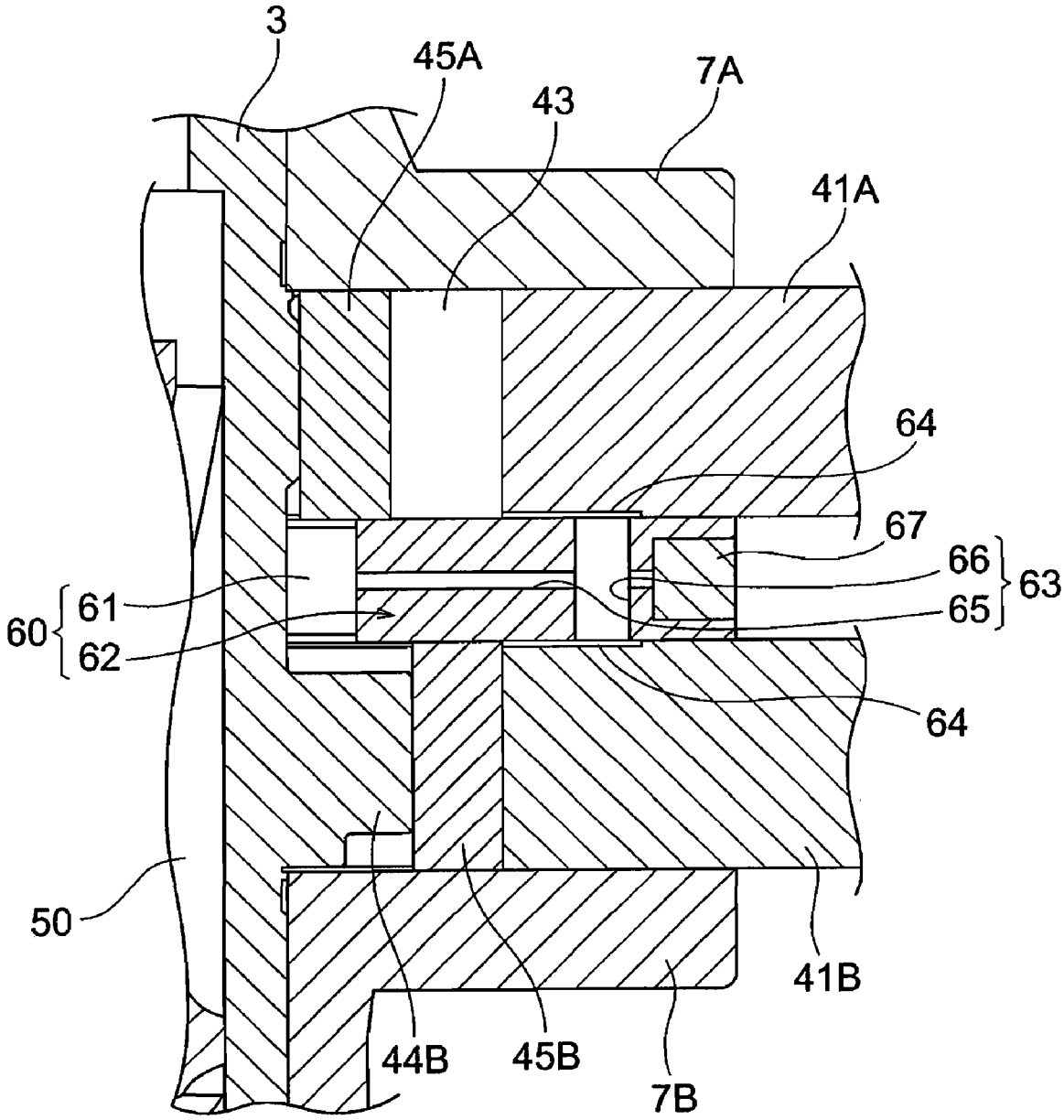
FIG. 4 is an enlarged longitudinally-sectional view showing an oil injecting portion.

As shown in FIG. 4, the oil injecting portion 60 comprises an oil stocking portion 61 for stocking the oil 8 and an oil path 62 for leading the oil 8 stocked in the oil stocking portion 61 to the compression chamber 43 of each of the cylinders 41A and 41B.

The oil stocking portion 61 is formed by providing an annular space along the outer peripheral surface of the crank shaft 3 at the rubbing face of the partition plate 42 against the crank shaft 3. Accordingly, when the oil pickup 50 supplies the oil 8 to each rubbing portion between the rotary compressing element 4 and the crank shaft 3, a part of the oil 8 is stocked in the oil stocking portion 61.

The oil path 62 is designed so as to extend from the oil stocking portion 61 and intercommunicate with the compressing chambers 43 of the respective cylinders 41A and 41B. During the suction process of the refrigerant, the oil 8 in the oil stocking portion is led to the compressing chambers 43.

More specifically, the oil path 62 comprises an secondary oil path 63 formed in the partition plate 42, and a primary oil path 64 formed in each of the cylinders 41A and 41B so as to intercommunicate with the secondary oil path 63.

The secondary oil path 63 comprises a first oil path 65 penetrating from the outer peripheral surface of the partition plate 42 to the oil stocking portion 61, the opening thereof at the outer peripheral surface of the partition plate 42 being closed by a plug 67, and a second oil path 66 penetrating through the partition plate in the vertical direction (thickness direction) of the partition plate 42 and intercommunicating with the first oil path 65. The oil 8 stocked in the oil stocking portion 61 is led to the respective primary oil paths 64 of the cylinders 41A and 41B through the first oil path 65 and the second oil path 66.

The primary oil path 64 is provided to each of the lower surface of the cylinder 41A at the upper stage and the upper surface of the cylinder 41B at the lower stage. One ends of the primary oil paths 64 intercommunicate with the upper and lower opening ends of the second oil path 66 formed in the partition plate 42, and the other ends thereof are formed as narrow grooves extending to the compression chambers 43, so that the oil 8 led from the secondary path 63 is led through the primary oil paths 64 into the compression chambers 43.

In order to inject the oil 8 stocked in the oil stocking portion 61 into the compression chamber 43 in connection with suction of the refrigerant into the low-pressure chamber side 43A of the compression chamber 43, one end 64A of the primary oil 64 is opened to the inner surface 49 of the cylinder 41A of the low-pressure chamber side 43A. The primary oil path 64 of the cylinder 41B at the lower stage have the same structure as the primary oil 64 at the cylinder 41A side of the upper stage.

That is, the discharge pressure of the refrigerant (for example, 3 MPa) is applied to the oil 8 in the hermetically sealed container 1. Therefore, by opening one end of the primary oil path 64 to the inner surface 49 of the cylinder of the low-pressure chamber side 43A, the high-pressure oil 8 stocked in the oil stocking portion 61 is passed through the oil path 62 comprising the secondary oil path 63 and the primary oil paths 64 into the low-pressure chamber side 43A of the compression chamber 43 of each of the cylinders 41A, 41B on the basis of the differential pressure of the high-pressure oil 8 from the inner pressure (for example, 1.1 MPa) of the low-pressure chamber side 43A of the compression chamber 43 during the refrigerant suction process.

As a result, the oil 8 is injected into the compression chambers 43 in connection with the suction of the refrigerant, and thus sufficient oil film is formed between the inner surface 49 of each cylinder and each of the rollers 45A and 45B by the oil 8, thereby enhancing the sealing performance.

Accordingly, the low-pressure chamber side 43A and the high-pressure chamber side 43B are surely separated from each other in the compression chamber 43 of each of the cylinders 41A, 41B. Therefore, in the process (compression process) that the refrigerant sucked into the low-pressure chamber side 43A is fed to the high-pressure chamber side 43B and compressed, the compressed refrigerant can be prevented from leaking to the low-pressure chamber side 43A, and the refrigerant compression efficiency is enhanced, so that the cooling efficiency of the hermetically sealed rotary compressor 100 can be enhanced.

When one end 64A of the primary oil path 64 is formed to be opened at an angle in a predetermined angle range from θ1 to θ2 (θ1: 0°, θ2: 170°, more preferably θ1: 125°, θ2: 165°) with respect to a reference line L connecting the suction port 48 and the center point O of the cylinder 41A, thereby further enhancing the compression efficiency of the refrigerant (about 55° in the example of FIG. 3).

Here, the amount of the oil 8 injected into the compression chamber 43 during the refrigerant suction process can be adjusted by adjusting the cross-section area (opening area) D of the primary oil path opened to the inner surface 49 of each cylinder 41A, 41B. According to this embodiment, in order to set the amount of the oil 8 injected into the compression chamber 43 to a proper amount, the cross-section area D is determined so that the ratio R (=D/V) of the cross-section area D of the primary oil path 64 and the displacement volume of the compression chamber 43 is converged within a predetermined range.

More specifically, if the ration R is excessively small, the primary oil path 64 is excessively narrow and the oil 8 is not injected into the compression chamber 43. On the other hand, if the ratio R is excessively large, the oil 8 is excessively injected into the compression chamber 43 and thus liquid compression occurs. Therefore, according to this embodiment, the ratio R is set to fall in the range from 0.004 to 0.03 ($mm^2/cc$), and the cross-sectional area D of the primary oil path 64 is determined on the basis of the ratio R, whereby the sealing performance between the inner surface 49 of the cylinder and the roller 45A is enhanced with preventing the liquid compression due to excessive injection of the oil 8.

According to this embodiment, the oil 8 is injected into the compression chamber 43 in connection with the suction of the refrigerant into the compression chamber 43. Therefore, sufficient oil film is formed between the cylinder 41A (41B) and the roller 45A (45B) by the oil 8 injected into the compression chamber 43 to thereby enhance the sealing performance. Accordingly, the refrigerant under compression process is prevented from leaking into the low-pressure chamber side 43A, and the compression efficiency is enhanced, so that the cooling efficiency of the hermetically sealed rotary compressor 100 can be enhanced.

According to this embodiment, the ratio between the cross-sectional area D of the primary oil 64 constituting the oil path 62 and the displacement volume V of the compression chamber 43 is set to a value in a predetermined range, so that the sealing performance between the inner surface 49 of the cylinder and the roller 45A is enhanced with preventing liquid compression due to excessive injection of the oil 8.

In this embodiment, the hermetically sealed rotary compressor 100 having the two cylinders 41A, 41B is described. However, the present invention is not limited to the above embodiment, and the present invention may be applied to a hermetically sealed rotary compressor 100' having one cylinder.

Figure 5:
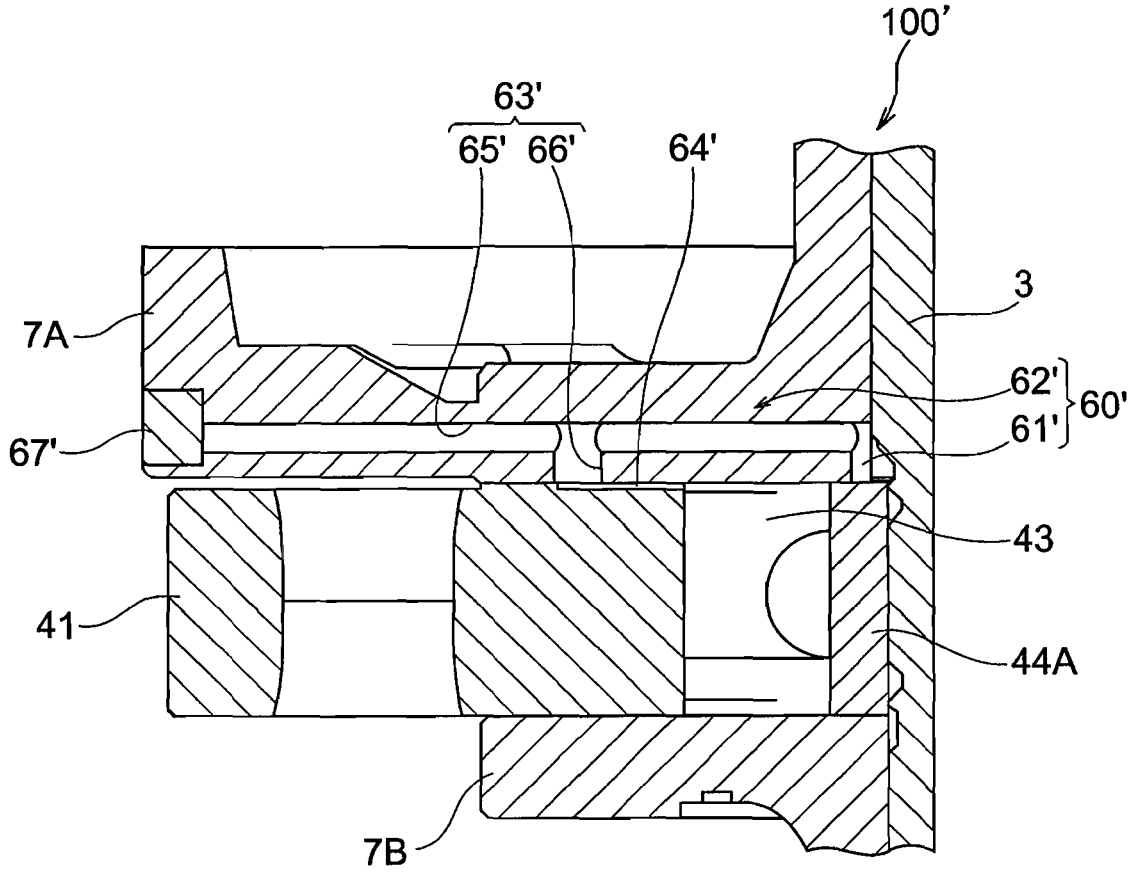
FIG. 5 is a diagram showing a modification of the first embodiment.

Specifically, when the hermetically sealed rotary compressor 100' is constructed so that one cylinder 41 is disposed between the primary bearing 7A and the secondary bearing 7B as shown in FIG. 5, it may be designed so that an oil stocking portion 61' is provided between the primary bearing 7A and the crank shaft 3, an secondary oil path 63' for leading the oil stocked in the oil stocking portion 61' to the upper surface of the cylinder 41 is formed in the primary bearing 7A, and a primary oil path 64' that intercommunicates with the secondary oil 63' and leads the oil 8 to the compression chamber 43 of the cylinder 41 is formed on the upper surface of the cylinder 41. Furthermore, when the secondary oil path 63' is formed in the primary bearing 7A, the hermetically sealed rotary compressor 100' may be designed so that a first oil path 65' is formed so as to penetrate from the outer peripheral surface of the primary bearing 7A through the primary bearing 7A to the oil stocking portion 61', a second oil path 66' is provided so as to extend from the lower surface of the primary bearing 7A in the vertical direction and intercommunicate with the first oil path 65', and one end of the first oil path 65' is closed by a plug 67'.

Second Embodiment

Next, a second embodiment according to the present invention will be described.

Figure 6:
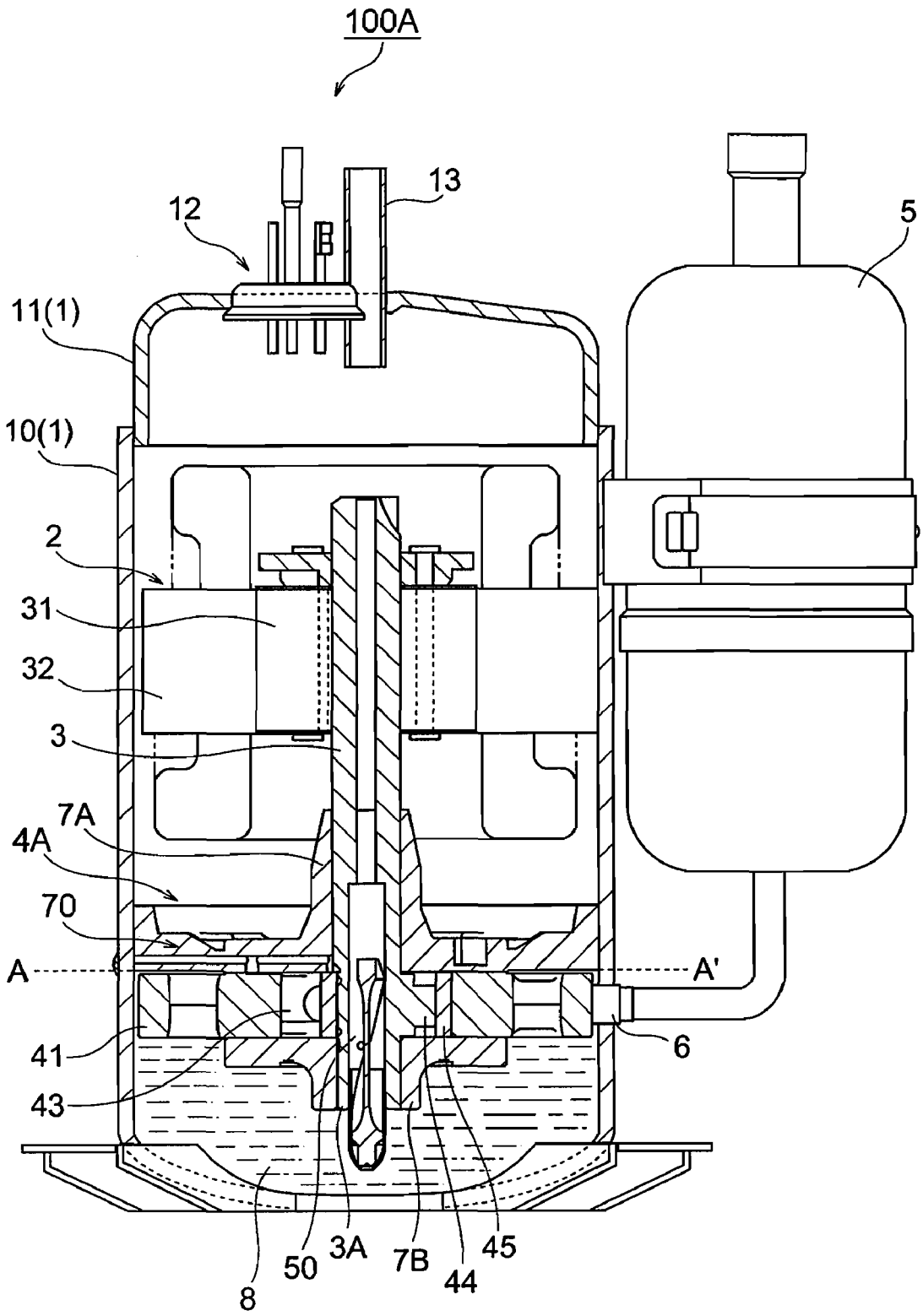
FIG. 6 is a longitudinally-sectional view showing the construction of a hermetically sealed rotary compressor according to a second embodiment of the present invention.
Figure 7:
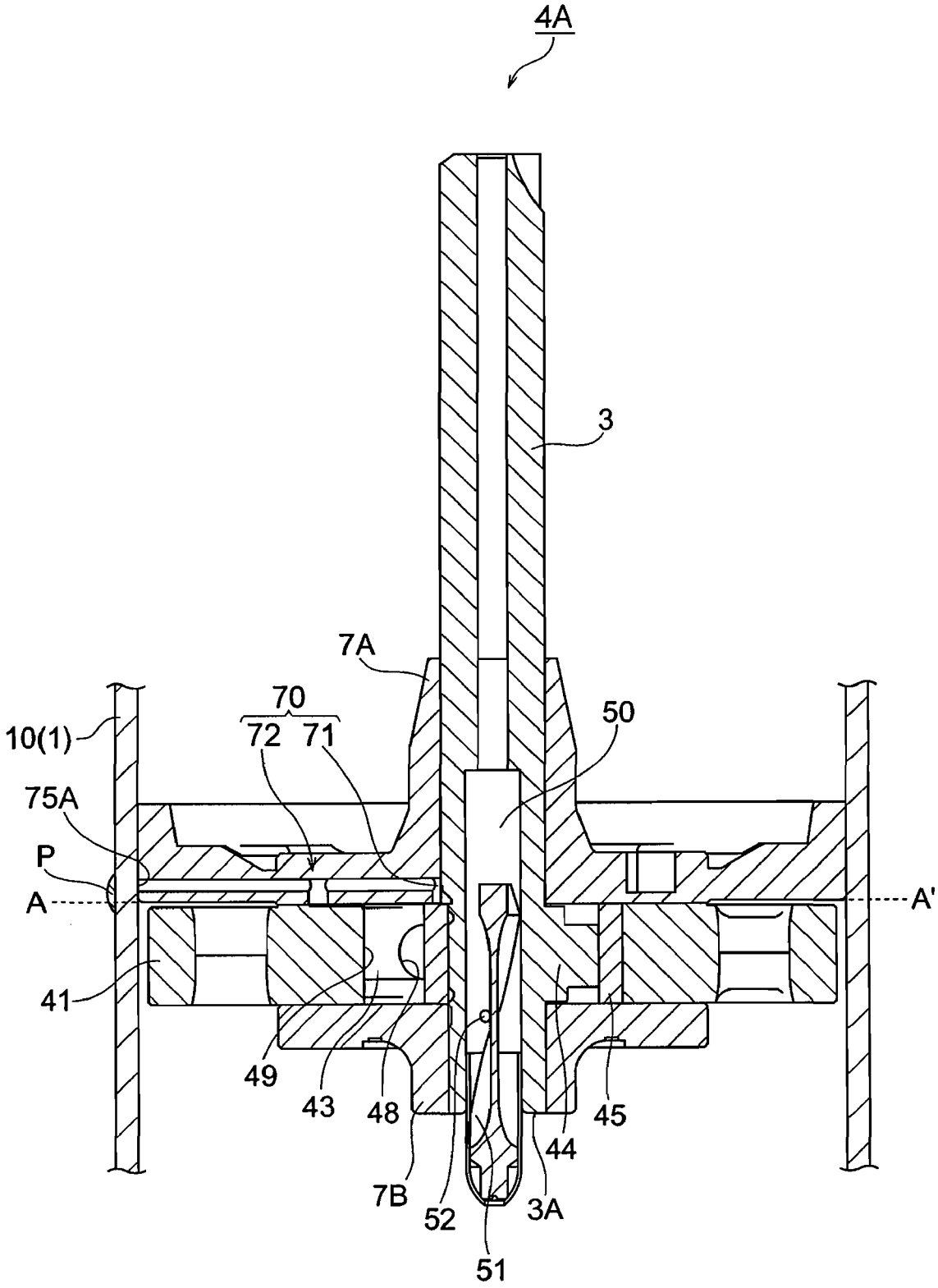
FIG. 7 is an enlarged longitudinally-sectional view showing a rotary compressing element.

FIG. 6 is a longitudinally-sectional view showing a hermetically sealed rotary compressor 100A according to a second embodiment of the present invention, and FIG. 7 is an enlarged longitudinally-sectional view showing a rotary compressing element.

As shown in FIGS. 6 and 7, the hermetically sealed rotary compressor 100A is greatly different in the construction of the rotary compressing element from the first embodiment. The construction of the other parts are substantially the same as the first embodiment, and thus the rotary compressing element of the second embodiment will be described in detail in the following description. The same elements as the first embodiment are represented by the same reference numerals, and the description thereof is omitted.

The rotary compressing element 4A is constructed so as to have one cylinder 41 unlike the rotary compressing element 4 of the first embodiment shown in FIGS. 1 and 2. Specifically, the cylinder 41 is sandwiched between the primary bearing 7A (support member) and the secondary bearing 7B, and integrally fixed to the primary bearing 7A and the secondary bearing 7B by bolts or the like.

The primary bearing 7A is fixed to the inner surface of the hermetically sealed container 1, and the cylinder 41 is supported in the hermetically sealed container 1 by the primary bearing 7A. The upper side opening of the cylinder of the cylinder 41 is closed by the primary bearing 7A, and the lower side opening thereof is closed by the secondary bearing 7B, thereby forming the compression chamber in the cylinder 41.

Figure 8:
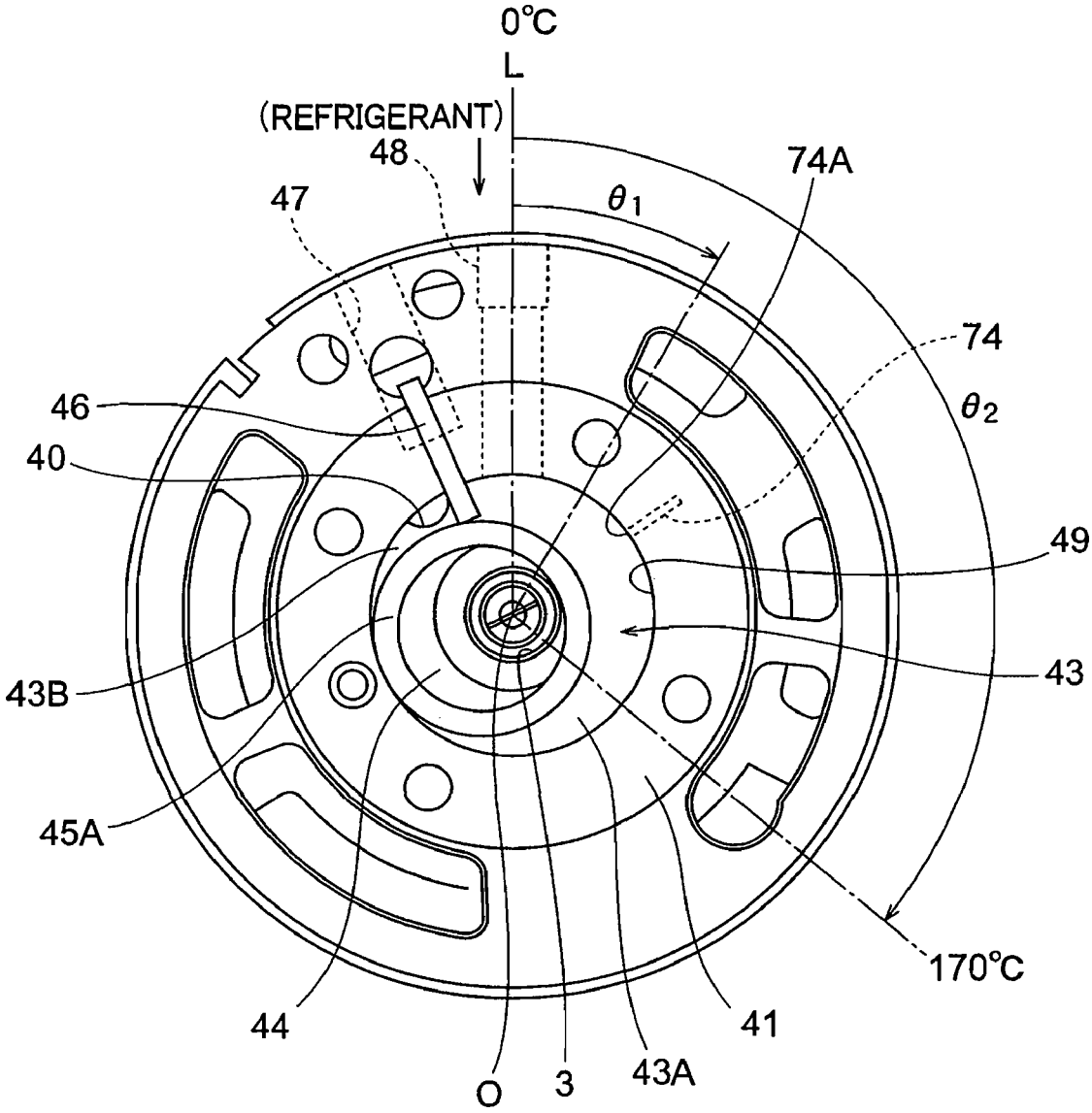
FIG. 8 is a plan view showing the construction of the cylinder.

As shown in FIG. 8, a roller 45 is provided in the compression chamber 43, and a vane 6 is disposed therein. The crescent-shaped compression chamber 43 is partitioned into a low-pressure chamber side 43A and a high-pressure chamber side 43B by the vane 46. A shown in FIG. 6, a suction pipe 6 is engagedly inserted in the suction port 48 of the cylinder 41, and a discharge valve is provided to the discharge port 40, and when the refrigerant pressure of the high-pressure chamber side 43B reaches a discharge pressure regulated by the discharge valve, the refrigerant is discharged from the discharge port 40 into the hermetically sealed container 1.

Accordingly, when the electrically-driven element 2 rotates the crank shaft 3, the roller 5 is eccentrically rotated in the compression chamber 43, whereby the refrigerant supplied from the outside of the compressor through the accumulator 5 is sucked through the suction pipe 6 into the low-pressure chamber side 43A of the compression chamber 43, and compressed while fed to the high-pressure chamber side 43B. Then, the compressed refrigerant is discharged from the discharge port 40 into the hermetically sealed container 1 and then discharged from the discharge pipe 13 to the outside of the compressor.

Furthermore, as shown in FIGS. 6 and 7, as in the case of the first embodiment, the oil 8 is filled at the bottom portion of the hermetically sealed container 1 till the lower surface of the primary bearing 7A (indicated by A-A' line in FIG. 7). Furthermore, the lower end portion 3A of the crank shaft 3 is provided with an oil pickup 50 serving as an oil supply device for supplying the oil 8 to the primary bearing 7A, the secondary bearing 7B, the rubbing portion between the rotary compressing element 4 and the crank shaft 3 and the sliding portion of the rotary compressing element 4.

Here, in order to enhance the refrigerant compression efficiency, the hermetically sealed rotary compressor 100A of this embodiment is also provided with an oil injecting portion 70 for injecting the oil 8 into the compression chamber 43 when the refrigerant is sucked into the compression chamber 43 as in the case of the first embodiment. The oil injection portion 70 comprises an oil stocking portion 71 that is provided to the primary bearing 7A and stocks the oil 8, and an oil path 72 for injecting the oil 8 stocked in the oil stocking portion 71 into the compression chamber 43.

The oil stocking portion 71 is formed by providing an annular space along the outer peripheral surface of the crank shaft at the rubbing face of the primary bearing 7A against the crank shaft 3. Accordingly, when the oil pickup 50 supplies the oil 8 to each rubbing portion between the rotary compression element 4A and the crank shaft 3, a part of the oil 8 is stocked in the oil stocking portion 71.

The oil path 72 comprises an secondary oil path 73 formed in the primary bearing 7A, and a primary oil path 74 formed on the cylinder 41 so as to intercommunicate with the secondary oil path 73. Specifically, the secondary oil path 73 comprises a first oil path 75 (through hole) penetrating from the outer peripheral surface of the primary bearing 7A to the oil stocking portion 71, and a second oil path 76 that is formed so as to extend from the lower surface of the primary bearing 7A upwardly (in the thickness direction) and intercommunicates with the first oil path 75. Accordingly, the oil 8 stocked in the oil stocking portion 71 is led to the primary oil path 74 of the cylinder 41 through the first oil path 75 and the second oil path 76.

The primary oil path 74 is provided on the upper surface of the cylinder 41, one end thereof is intercommunicated with the opening end of the second oil path 76, and the other end of the primary oil path 74 is formed as a narrow groove extending so as to intercommunicate with the compression chamber 43, whereby the oil 8 led from the secondary oil path 73 is passed through the primary oil path 74 and led into the compression chamber 43. As shown in FIG. 8, one end 74A of the primary oil 74 is formed so as to be opened to the inner surface of the cylinder of the low-pressure chamber side 43A so that the oil 8 stocked in the oil stocking portion 71 is injected into the compression chamber 43 in connection with the suction of the refrigerant into the low-pressure chamber side 43A of the compression chamber 43.

That is, as in the case of the first embodiment, the refrigerant discharge pressure (for example, 3 MPa) is applied to the oil 8 in the hermetically sealed container 1. Accordingly, by opening one end 74A of the primary oil path 74 to the inner surface 49 of the cylinder of the low-pressure chamber side 43A, the high-pressure oil 8 stocked in the oil stocking portion 71 is passed through the oil path 72 comprising the secondary oil path 73 and the primary oil path 74 and then injected into the low-pressure chamber side 43A of the compression chamber 43 of the cylinder 41 by the differential pressure of the oil from the inner pressure (for example, 1.1 MPa) of the low-pressure chamber 43A of the compression chamber 43 during the suction process of the refrigerant into the compression chamber 43.

As a result, the oil 8 is injected into the compression chamber 43 in connection with the suction of the refrigerant into the compression chamber 43, so that sufficient oil film is formed between the inner surface 49 of the cylinder and the roller 45 by the oil 8 and the sealing performance is enhanced.

According to this embodiment, as in the case of the first embodiment, one end 74A of the primary oil path 74 is formed to be opened at an angle within a predetermined angle range from θ1 to θ2 (θ1: 0°, θ2: 170°, more preferably θ1: 125°, θ2: 165°) with respect to a reference line L connecting the suction port 48 and the center point O of the cylinder 41A, thereby further enhancing the compression efficiency of the refrigerant (about 55° in the example of FIG. 8).

Furthermore, as in the case of the first embodiment, the cross-section (opening area) D of the primary oil path 74 is set so that the ratio R (=D/V) between the cross-section area D and the displacement volume v of the compression chamber 43 falls in a predetermined range, for example, in the range from 0.004 to 0.03 ($mm^2$/cc), whereby the liquid compression due to excessive injection of the oil 8 can be prevented and the sealing performance between the inner surface 49 of the cylinder and the roller 45 is enhanced.

In this embodiment, the oil path 72 provided to the oil injecting portion 70 is provided to the primary bearing 7A, and the oil path 72 is equipped with a first oil path 75 penetrating from the outer peripheral surface of the primary bearing 7A to the oil stocking portion 71. Accordingly, the opening end 75A is required to be closed to prevent leakage of the oil 8 from the opening end of first oil path 75 at the outer peripheral surface side of the primary bearing 7A. Therefore, according to this embodiment, in the process of fabricating the hermetically sealed rotary compressor 100A, the opening end 75A of the first oil path 75 is closed at the same time when the rotary compressing element 4A is fixed to the hermetically sealed container 1.

Figure 9:
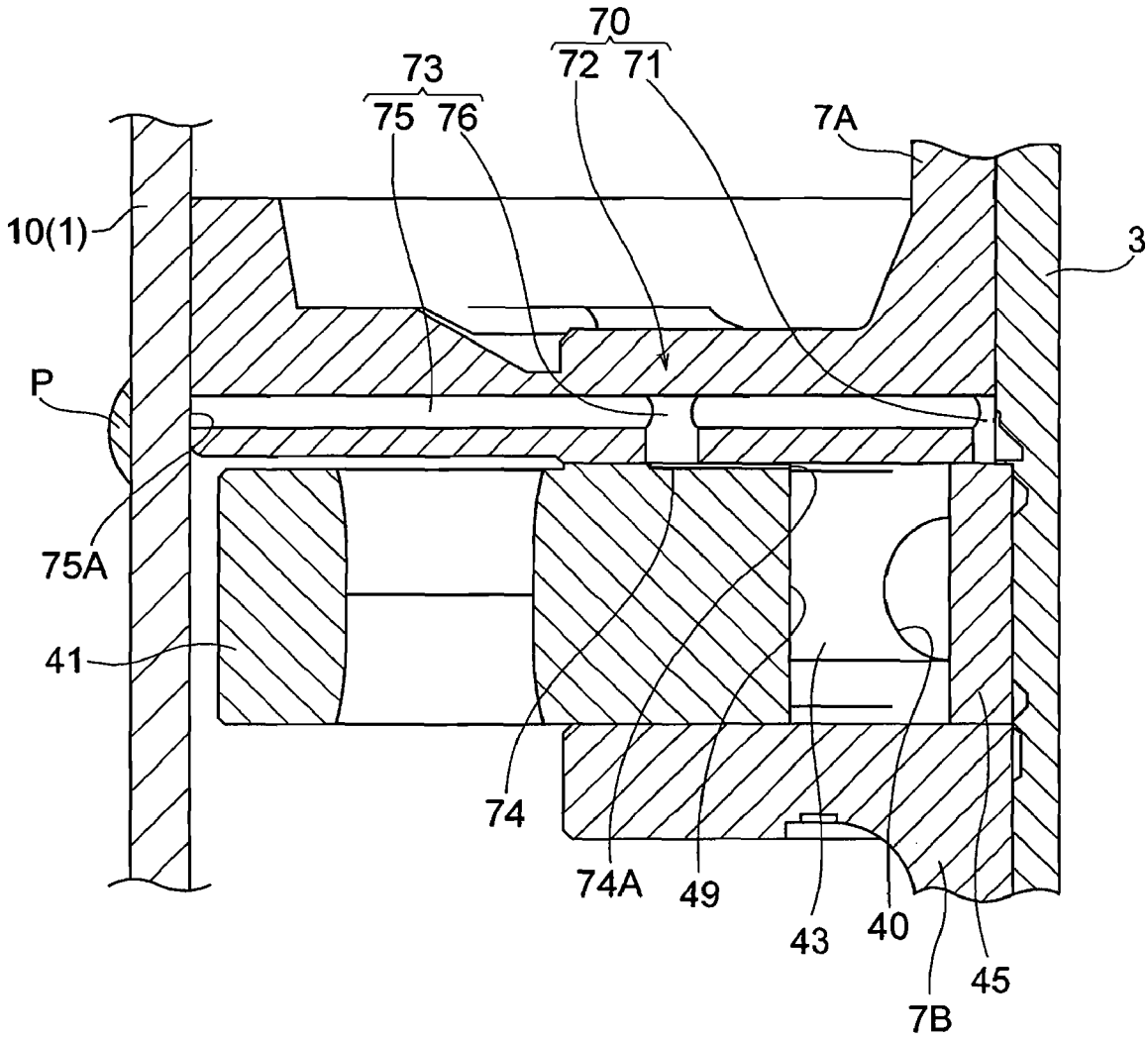
FIG. 9 is an enlarged longitudinally-sectional view showing an oil injecting portion.

In the fabrication process, the primary bearing 7A and the secondary bearing 7B are first fixed to the upper and lower surfaces of the cylinder 41 by bolts or the like to fabricate the rotary compressing element 4A. Subsequently, the rotary compressing element 4A is inserted into the hermetically sealed container 1 and positioned, and then the primary bearing 7A is fixed to the hermetically sealed container 1 by tack-welding plural places along the outer periphery of the hermetically sealed container 1 from the outside of the hermetically sealed container 1. When the tack-welding is carried out, the place P corresponding to the opening end 75A of the first oil path 75, that is, the place P at which the opening end 75A abuts against the inner surface of the hermetically sealed container 1 is subjected to tack welding as shown in FIGS. 7 and 9. By the tack welding described above, the opening end 75A of the first oil path 75 is brought into close contact with the inner surface of the hermetically sealed container 1 and closed simultaneously with the fixing of the rotary compressing element 4A to the hermetically sealed container 1.

As described above, according to this embodiment, the opening end 75A of the first oil path 75 is closed at the same time when the rotary compressing element 4A is fixed to the hermetically sealed container 1, and thus it is unnecessary to close the first oil path 75 (through hole) by a plug or the like. Accordingly, the cost is reduced, and the number of steps for the fabrication work of the hermetically sealed rotary compressor 100A is also reduced, so that the productivity is enhanced.

When the rotary compressing element 4A is fixed to the hermetically sealed container 1 from the outside of the hermetically sealed container 1 by tack-welding, there is a risk that the tack-welded place is displaced from the position corresponding to the opening end 75A of the first oil path 75A. In order to avoid this risk, in the fabrication process, before the rotary compressing element 4A is inserted into the hermetically sealed container 1, the rotary compressing element 4A is positioned so that the opening end 75A of the first oil path 75A is located at the tack-welding place P. In order to maintain this positioning, when the rotary compressing element 4A is inserted into the hermetically sealed container 1, the rotary compressing element 4A is inserted into the hermetically sealed container 1 while the primary bearing 7A (support member) as a non-movable member is gripped, and then the tack-welding is conducted on the tack-welding place P. Accordingly, the positioning is prevented from being disturbed when the rotary compressing element 4A is inserted into the hermetically sealed container 1, and the place P corresponding to the opening end 75A of the first oil path 75A is surely tack-welded to close the opening end 75A.

In place of the manner of positioning the rotary compressing element 4A before the rotary compressing element 4A is inserted into the hermetically sealed container 1, there may be used a manner of providing a positioning member onto each of the inner peripheral surface of the hermetically sealed container 1 and the outer peripheral surface of the primary bearing 7A so that the opening end 75*a* of the first oil path 75A is positioned to the tack-welding place P, and positioning the rotary compressing element 4A by using the positioning member when the rotary compressing element 4A is inserted. The positioning member may be constructed by providing a projection onto any one of the inner peripheral surface of the hermetically sealed container 1 and the outer peripheral surface of the primary bearing 7A of the rotary compressing element 4A and also providing the other surface with a guide groove for guiding the projection when the rotary compressing element 4A is inserted. The positioning member may be constructed by providing an engaging member that is engaged at a predetermined position to thereby perform the positioning when the rotary compressing element 4A is rotated around the axis of the crank shaft 3 after the rotary compressing element 4A is inserted in the hermetically sealed container 1.

As described above, according to this embodiment, as in the case of the first embodiment, the oil 8 is injected into the compressor chamber 43 during the process of sucking the refrigerant into the compression chamber 43. Therefore, sufficient oil film can be formed between the cylinder 41 and the roller 45 by the oil 8 injected into the compression chamber 43, and thus the sealing performance can be enhanced. Accordingly, the refrigerant under compression is prevented from leaking into the low-pressure chamber side 43A, and the compression efficiency is enhanced, so that the cooling efficiency of the hermetically sealed rotary compressor 100A can be enhanced.

Furthermore, according to this embodiment, the ratio between the cross-sectional area D of the primary oil path 74 constituting the oil path 72 and the displacement volume V of the compression chamber 43 is set to be within a predetermined range. Therefore, the liquid compression caused by the excessive injection of the oil 8 can be prevented, and the sealing performance between the inner surface 49 of the cylinder and the roller 45 can be enhanced.

Furthermore, according to this embodiment, the primary bearing 7A for supporting the cylinder 41 in the hermetically sealed container 1 is provided with the first oil path 75 penetrating from the crank shaft 3 to the outer peripheral surface of the primary bearing 7A to thereby construct the oil path 72, and when the primary bearing 7A is fixed to the hermetically sealed container 1 by carrying out welding from the outside of the hermetically sealed container 1, the place P corresponding to the opening end 65A at the outer peripheral surface side of the first oil path is subjected to tack-welding to close the opening end 75A. Therefore, it is unnecessary to close the first oil path 75 by using a plug or the like, and the cost can be reduced. Furthermore, since the first oil path 75 is closed by the welding work when the rotary compressing element 4A is fixed to the hermetically sealed container 1, so that the number of steps for the fabrication work can be reduced and the productivity can be enhanced.

Still furthermore, according to this embodiment, before the rotary compressing element 4A is inserted in the hermetically sealed container 1, the rotary compressing element 4A is positioned so that the opening end 75A of the first oil path 75A is located at the tack-welding place P. Thereafter, when the rotary compressing element 4A is inserted in the hermetically sealed container 1, the primary bearing 7A as a non-movable member is gripped. Therefore, the positioning of the rotary compressing element 4*a* is prevented from being disturbed when the rotary compressing element 4A is inserted, whereby the opening end 75A can be surely closed by the tack welding.

Furthermore, the positioning member for positioning the rotary compressing element 4A so that the opening end 75A of the first oil path 75A is located at the tack welding place P may be provided to each of the inner surface of the hermetically sealed container 1 and the outer peripheral surface of the primary bearing 7A of the rotary compressing element 4A. In this case, when the rotary compressing element 4A is inserted in the hermetically sealed container 1, the rotary compressing element 4A is positioned by the positioning members, so that the place corresponding to the opening end 75A can be surely welded.

Still furthermore, in the above-described embodiment, the hermetically sealed rotary compressor 100A is equipped with one cylinder 41. However, the present invention is not limited to this type of compressor, and it may be applied to a hermetically sealed rotary compressor having two cylinders as in the case of the first embodiment.

Figure 10:
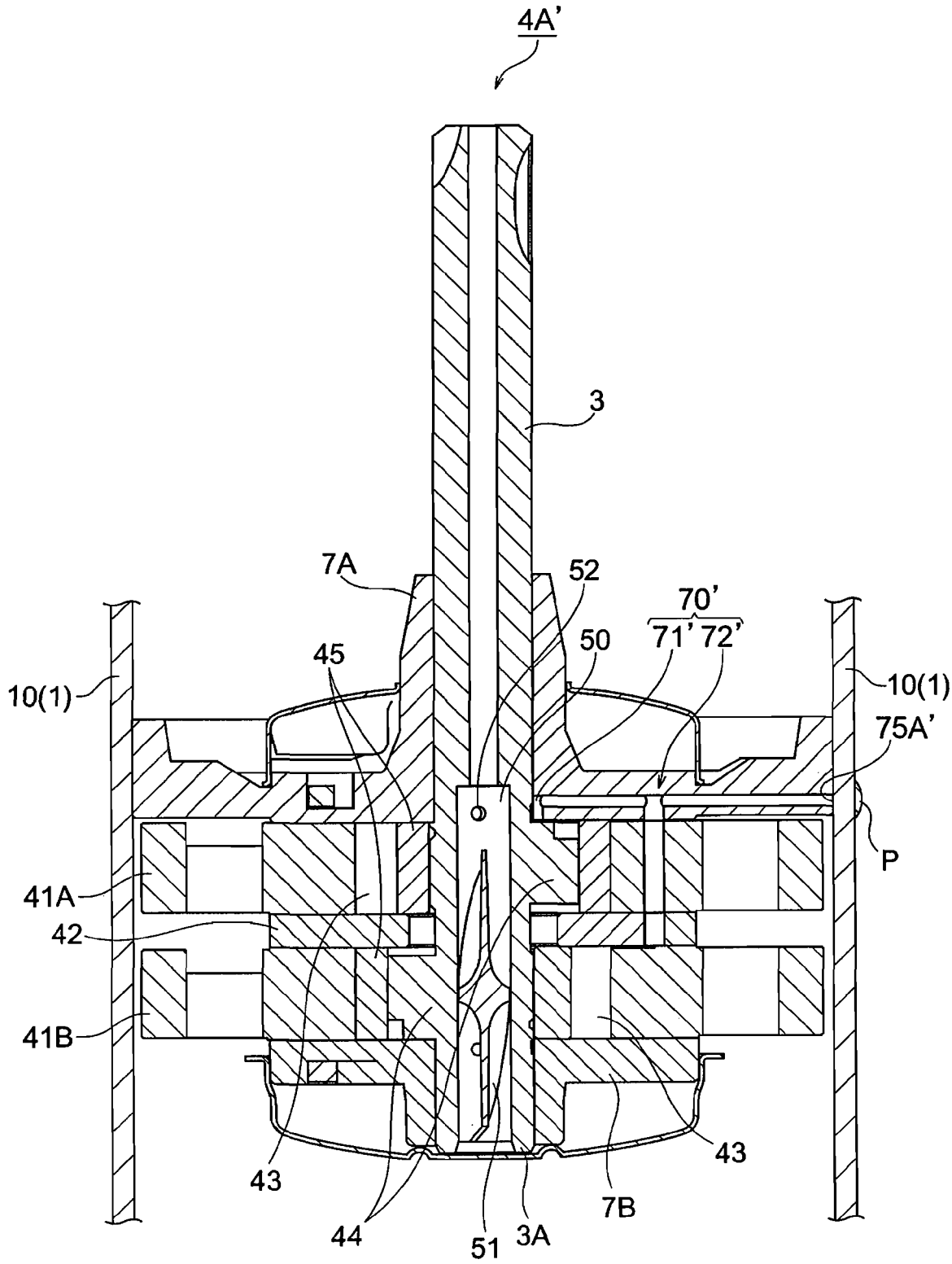
FIG. 10 is a diagram showing a modification of the second embodiment.
Figure 11:
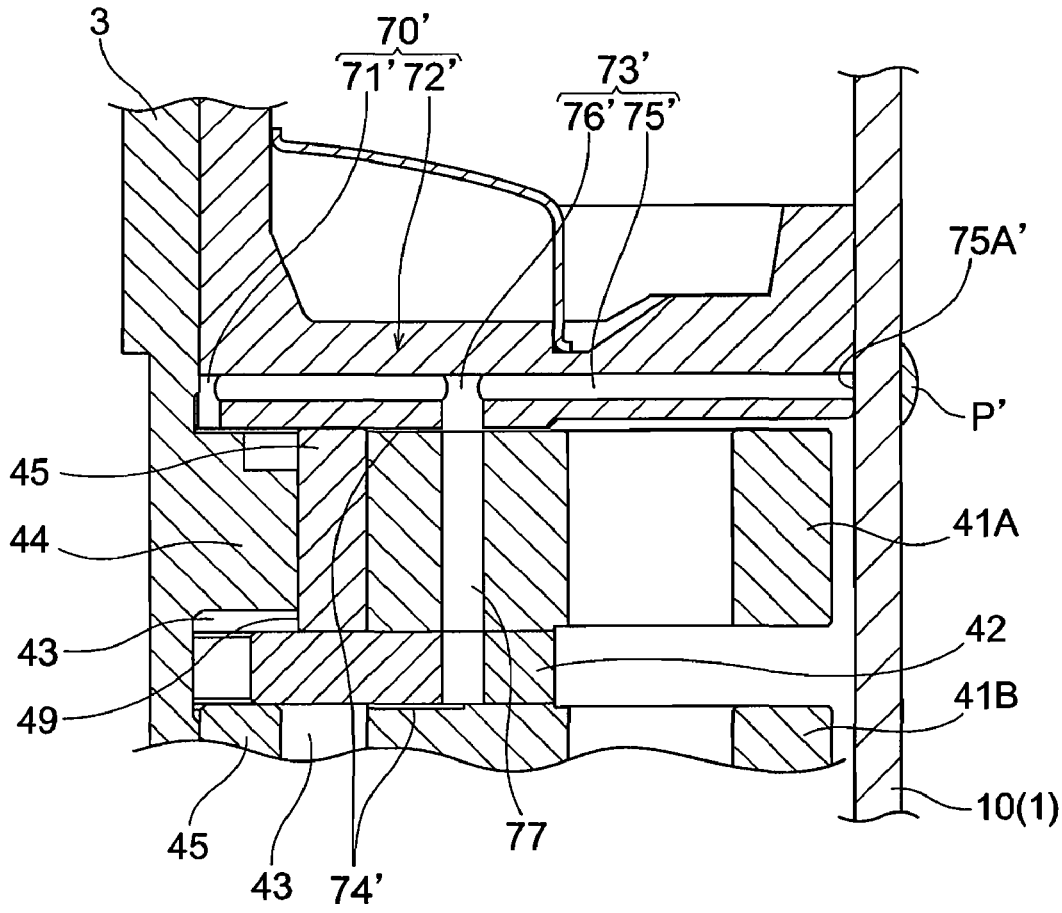
FIG. 11 is an enlarged longitudinally-sectional view showing an oil injecting portion.

FIGS. 10 and 11 show a rotary compressing element 4A' having two cylinders. In the following description, the same elements as the first embodiment are represented by the same reference numerals.

In the rotary compressing element 4A' having two cylinders as shown in FIGS. 10 and 11, the cylinders 41A and 41B are disposed in the vertical direction between the primary bearing 7A and the secondary bearing 7B so as to sandwich the partition plate 42 therebetween. The opening face at the upper side of the cylinder 41A at the upper stage is closed by the primary bearing 7, and the opening face at the lower side thereof is closed by the partition plate 42. Furthermore, the opening face at the lower side of the cylinder 41B at the lower stage is closed by the secondary bearing 7B, and the opening face at the upper side thereof is closed by the partition plate 42, whereby the compression chambers 43 are formed in the cylinders 41A, 41B.

In the rotary compressing element 4A' thus constructed, an oil stocking portion 71' of an oil injecting portion 70', and a secondary oil path 73' having a first oil path 75' (through hole) and a second oil path 76' are formed in the primary bearing 7A. Furthermore, a vertical oil path 77 is provided so as to penetrate through the cylinder 41A at the upper stage and the partition plate 42 in the vertical direction and intercommunicate with the second oil path 76' of the secondary oil path 73', and primary oil paths 74' are formed on the upper surface of the cylinders 41A, 41B so as to intercommunicate with the vertical oil path 77 and lead the oil 8 to the compression chambers 43. Accordingly, during the refrigerant suction process, the oil 8 stocked in the oil stocking portion 71' is led through the first oil path 75' to the primary oil path 74' of the cylinder 41A at the upper stage, and further led from the first oil path 75' through the vertical oil path 77 to the primary oil path 74' of the cylinder 41B at the lower stage.

When the rotary compressing element 4A' thus constructed is welded to the hermetically sealed container 1, the cylinder 41A, the partition plate 42 and the cylinder 41B are disposed between the primary bearing 7A and the secondary bearing 7B and fixed by bolts or the like. Thereafter, the rotary compressing element 4A' containing the above elements is inserted in the hermetically sealed container 1, and the place P' corresponding to the opening end 75A' of the first oil path 75' provided to the primary bearing 7A is tack-welded, so that the opening end 75A' is brought into close contact with the inner surface of the hermetically sealed container 1 and closed.

Third Embodiment

Next, a third embodiment according to the present invention will be described.

Figure 12:
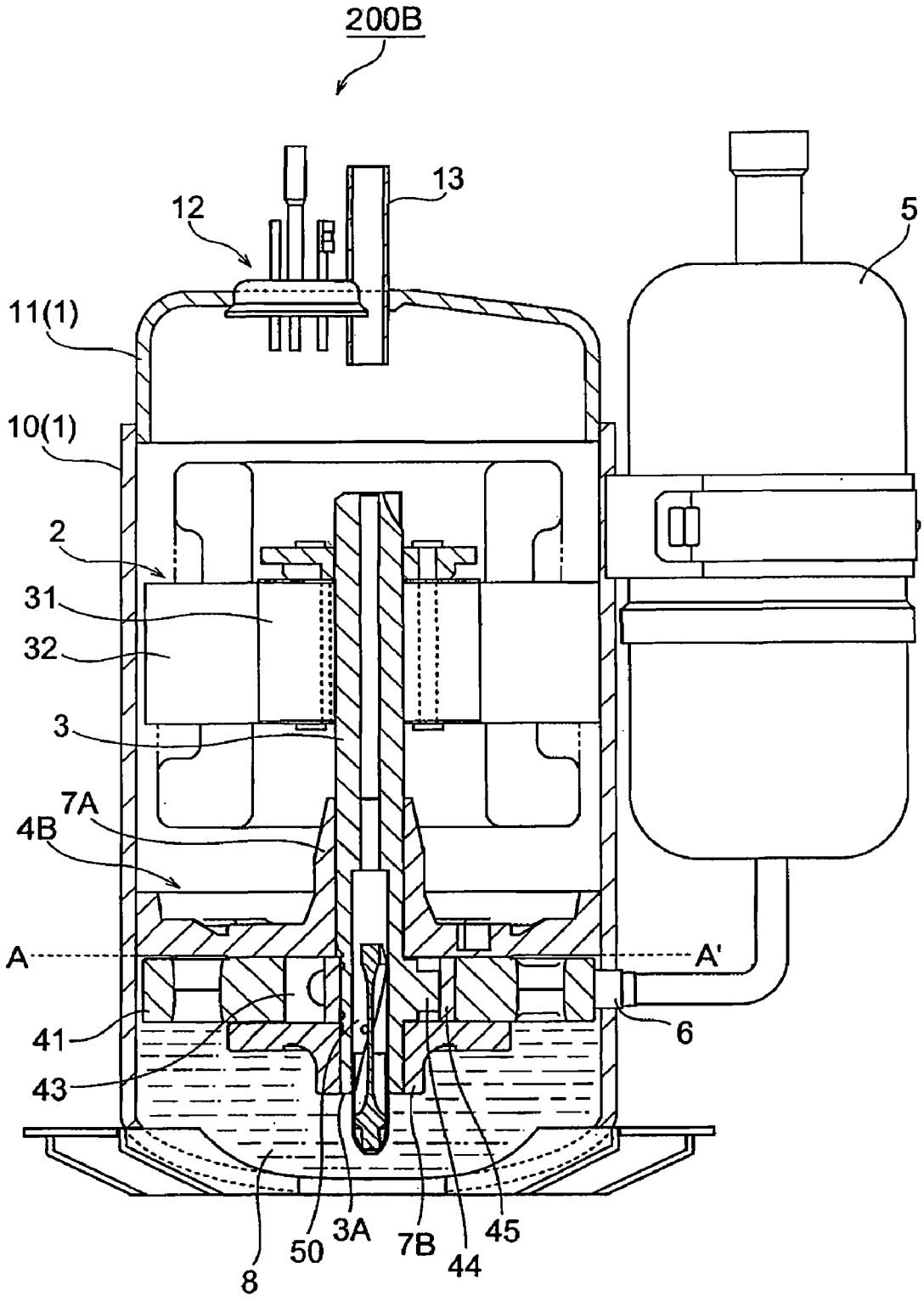
FIG. 12 is a longitudinally-sectional view showing the construction of a hermetically sealed rotary compressor according to a third embodiment of the present invention.
Figure 13:
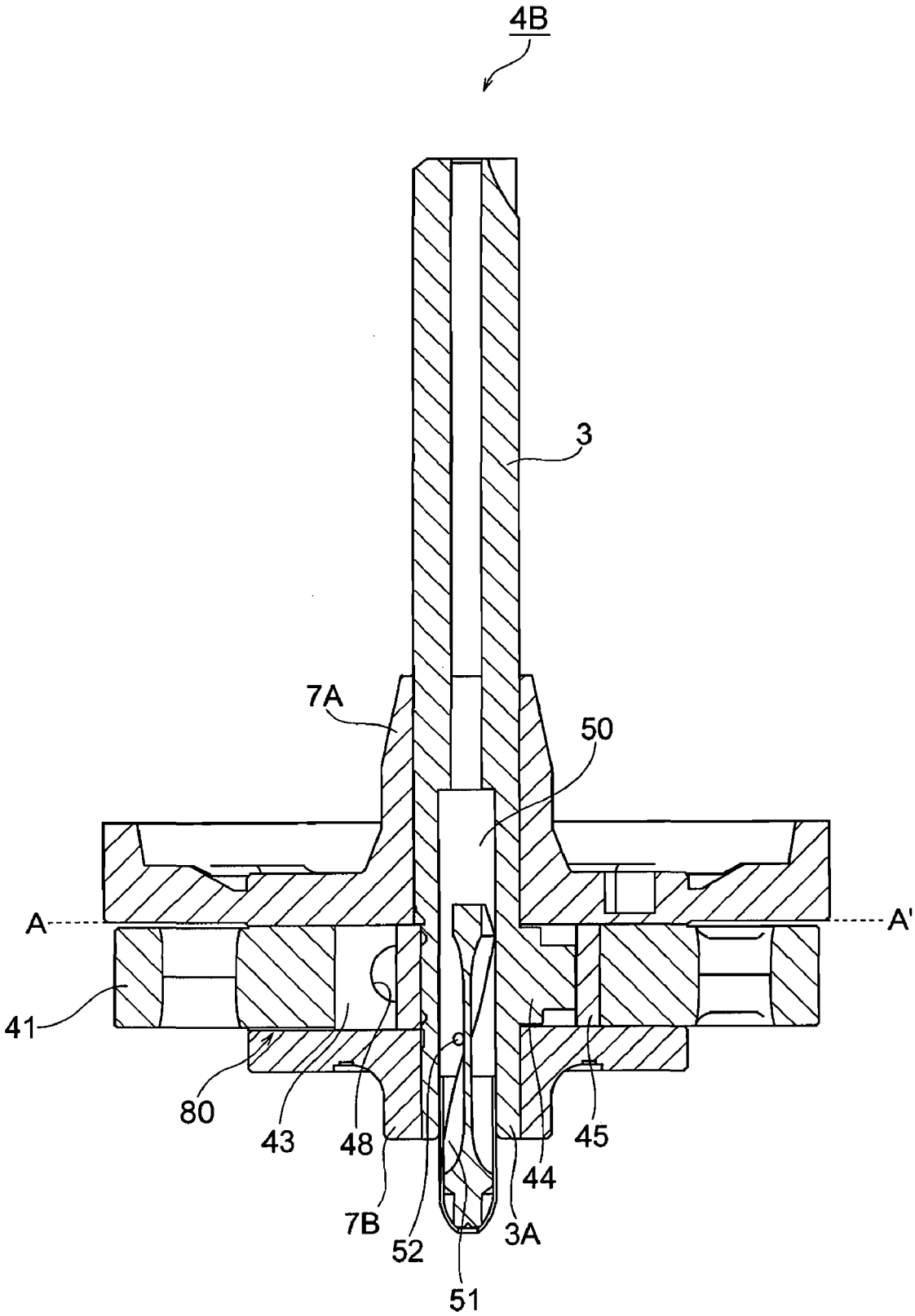
FIG. 13 is an enlarged longitudinally-sectional view showing a rotary compressing element.

FIG. 12 is a longitudinally-sectional view showing a hermetically sealed rotary compressor 200B according to a third embodiment of the present invention, and FIG. 13 is an enlarged longitudinally-sectional view. As shown in FIGS. 12 and 13, in the hermetically sealed rotary compressor 200B of this embodiment, a rotary compressing element 4B is equipped with one cylinder 41 as in the case of the second embodiment, and the basic construction thereof is similar to the second embodiment. Therefore, the same elements as the second embodiment are represented by the same reference numerals, and the description thereof is omitted.

In order to enhance the refrigerant compression efficiency, the hermetically sealed rotary compressor 200B is designed so that the oil 8 is injected into the compression chamber 43 when the refrigerant is sucked into the compression chamber 43 as in the case of the first and second embodiments. The construction of the hermetically sealed rotary compressor 200B will be described in detail.

Figure 15:
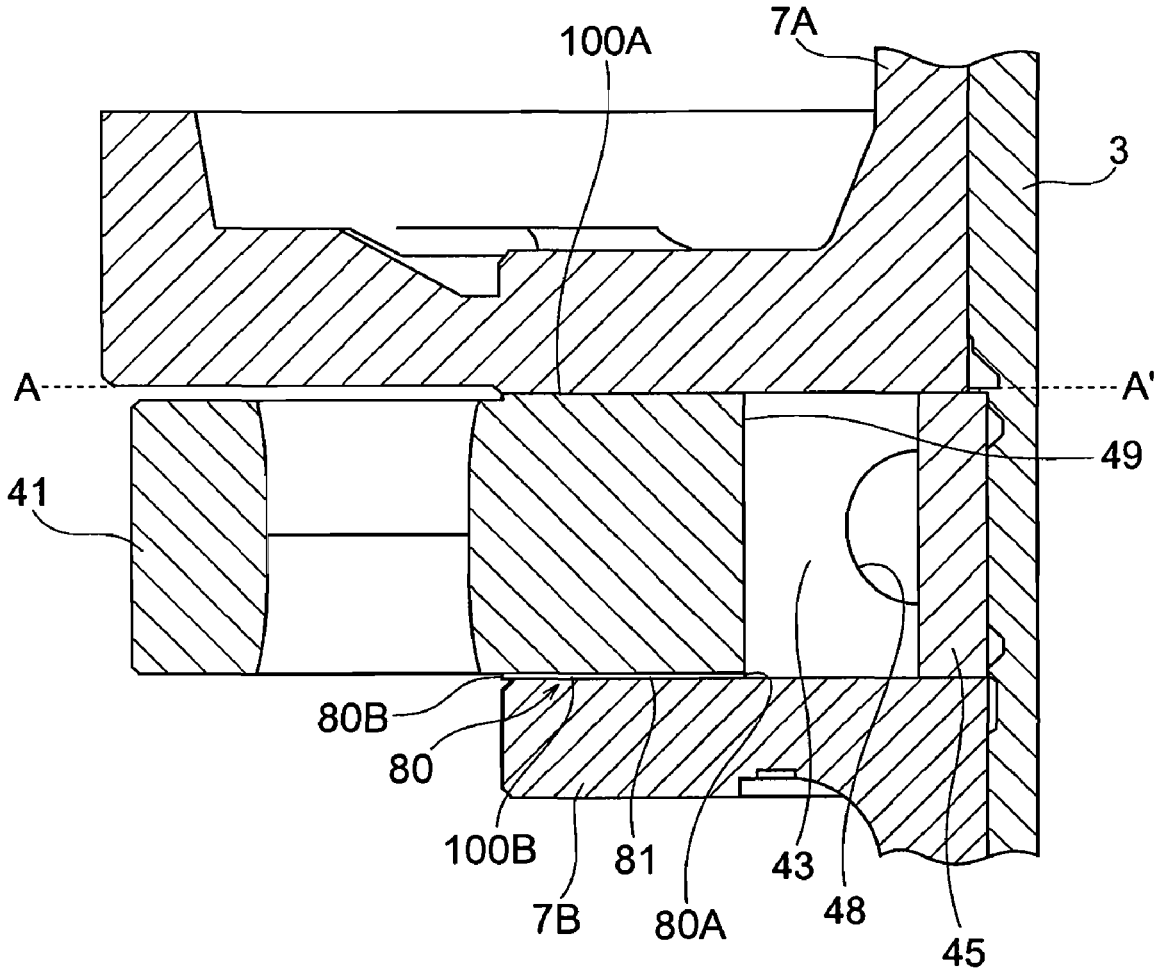
FIG. 15 is an enlarged longitudinally-sectional view showing an oil path.

As shown in FIG. 15, step portions 100A and 100B are formed within the contact surfaces with the primary bearing 7A and the secondary bearing 7B on the upper and lower surfaces of the cylinder 41 to enhance the close contact between the cylinder 41 and each bearing 7A, 7B.

Furthermore, a groove 81 extending in the radial direction is formed on the lower step portion 100B, that is, on the lower surface of the cylinder 41 in contact with the secondary bearing 7B by cutting work. When the step portion 100B and the secondary bearing 7B are brought into close contact with each other, one end 80A is opened to the inner surface of the cylinder 41 by the groove 81, and the other end 80B is opened to the oil 8 stocked in the hermetically sealed container 1 to thereby form an oil path 80. When the oil 8 is stocked in the hermetically sealed container 1 to the extent that the primary bearing 7A is immersed in the oil 8, the groove 81 may be formed on the upper step portion 100A, that is, on the upper surface of the cylinder 41 in contact with the primary bearing 7A, thereby forming the oil path 80.

Figure 14:
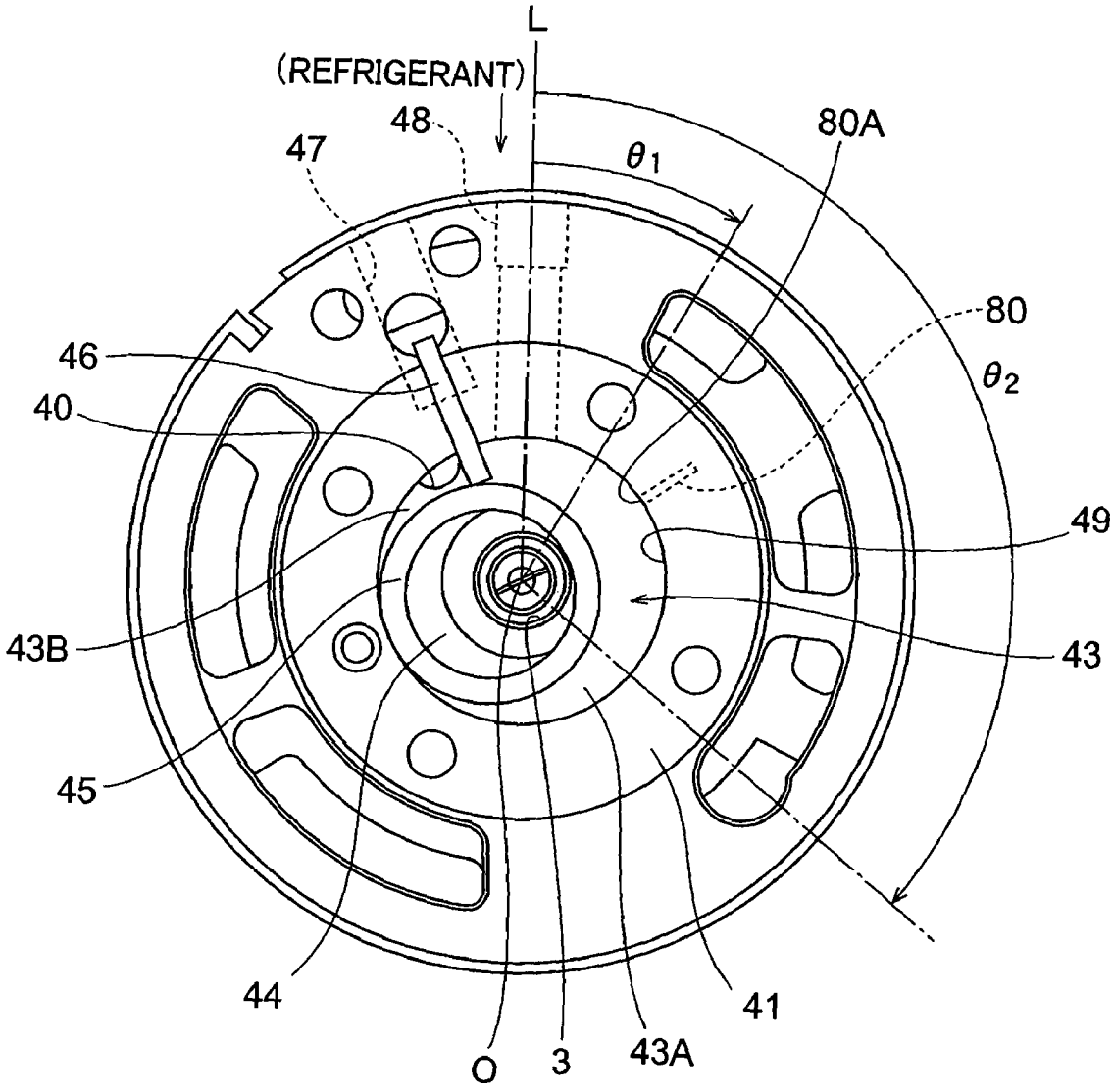
FIG. 14 is a plan view showing the construction of a cylinder.

One end 80A of the oil path 80 is opened to the inner surface 49 of the cylinder of the low-pressure chamber side 43A so that the oil 8 is injected into the compression chamber 43 in connection with the suction of the refrigerant into the compression chamber 43. Particularly, as shown in FIG. 14, one end 80A of the oil path 80 is opened at an angle in a predetermined angle range from $\theta 1$ to $\theta 2$ ($\theta 1$: 0°, $\theta 2$: 170°, more preferably $\theta 1$: 125°, $\theta 2$: 165°) with respect to a reference line L connecting the suction port 48 and the center point O of the cylinder 41, thereby further enhancing the compression efficiency of the refrigerant (about 55° in the example of FIG. 14).

That is, the discharge pressure of the refrigerant (for example, 3 MPa) is applied to the oil 8 in the hermetically sealed container 1. Therefore, by opening one end 80A of the oil path 80 to the inner surface 49 of the cylinder of the low-pressure chamber side 43A, the high-pressure oil 8 is passed through the oil path 80 and injected into the low-pressure chamber side 43A of the compression chamber 43 of the cylinder 43 by the differential pressure of the high-pressure oil 8 from the inner pressure (for example, 1.1 MPa) of the low-pressure chamber side 43A of the compression chamber 43 during the suction process of the refrigerant into the compression chamber 43.

Accordingly, sufficient oil film is formed between the inner surface 49 of the cylinder and the roller 45 by the oil injected to the compression chamber 43 when the refrigerant is sucked, and the sealing performance is enhanced by the oil film. As a result, the low-pressure chamber side 43A and the high-pressure chamber side 43B are surely separated from each other in the compression chamber 43 of the cylinder 41. Therefore, in the process (compression process) in which the refrigerant sucked to the low-pressure chamber side 43A is fed to the high-pressure chamber side 43B and compressed, the leakage of the compressed refrigerant to the low-pressure chamber side 43A is prevented, and the compression efficiency of the refrigerant is enhanced, so that the cooling efficiency of the hermetically sealed rotary compressor 200B can be enhanced.

Here, in this embodiment, by adjusting the cross-section area D of the oil path 80 opened to the cylinder inner surface 49 (that is, the cross-section area of the groove 81), the oil amount to be injected into the compression chamber 43 is adjusted. At this time, the cross-section area D is determined under the condition that the ratio R (=D/V) between the cross-section area D of the oil path 80 and the displacement volume V of the compression chamber 43 is set to a value in a predetermined range. Specifically, when the ratio R is excessively small, the oil path 80 is excessively narrow, and no oil 8 is injected into the compression chamber 43. Conversely, when the ratio R is excessively large, the oil 8 is excessively injected into the compression chamber 43, and thus liquid compression occurs. Therefore, it is preferable that the ratio R is set to fall in the range from 0.004 to 0.03 ($mm^2$/cc), whereby the sealing performance between the cylinder inner surface 49 and the roller 45 is enhanced with preventing liquid compression due to excessive injection of the oil 8.

As described above, according to this embodiment, as in the case of the fist and second embodiments, the oil 8 is injected into the compression chamber 43 during the suction process of the refrigerant into the compression chamber 43. Therefore, sufficient oil film is formed between the cylinder 41 and the roller 45 by the oil 8 injected to the compression chamber 43, and the sealing performance is enhanced. Accordingly, the leakage of the refrigerant into the low-pressure chamber side 43A during the compression process in the compression chamber 43 can be prevented, so that the compression efficiency is enhanced and thus the cooling efficiency of the hermetically sealed rotary compressor 200B can be enhanced.

Furthermore, according to this embodiment, the ratio between the cross-section area D of the oil path 80 for injecting the oil 8 into the compression chamber 43 and the displacement volume V of the compression chamber 43 is set to be within a predetermined range. Therefore, the sealing performance between the cylinder inner surface 49 and the roller 45 can be enhanced with preventing liquid compression due to excessive injection of the oil 8.

Still furthermore, according to this embodiment, the groove 81 of the oil path 80 is provided to the lower surface of the cylinder 41 making contact with the secondary bearing 7B (more accurately, the step portion 100B). Therefore, when the secondary bearing 7B and the cylinder 41 are fixed to each other, even if the secondary bearing 7B and the cylinder 41 are slightly positionally displaced from each other, the oil can be injected into the compression chamber 43 within given design limits without being affected by the positional displacement.

Specifically, the following trouble occurs when the groove 81 of the oil path 80 is formed on the upper surface of the secondary bearing 7B making contact with the cylinder 41. The oil path 80 in this case is formed by hermetically sealing the groove 81 provided to the upper surface of the secondary bearing 7B from the upper side by cylinder 41. Therefore, the opening of one end 80A of the oil path 80 which is located at the compression chamber 43 side is formed as a part of the groove 81 extending to the compression chamber 43 (a part which is not hermetically sealed by the cylinder 41) at the bottom surface of the inner surface 49 of the compression chamber 43. Here, if the positional displacement occurs at the time when the secondary bearing 7B is fixed to the compression chamber 43 side by a bolt or the like, the opening area of the oil path 80 at the compression chamber side 43 is deviated from the design value, and thus the injection amount of the oil 8 is deviated from the design value.

On the other hand, according to this embodiment, the groove 81 is provided at the cylinder 41 side. Accordingly, even if positional displacement occurs when the secondary bearing 7B is fixed to the cylinder 41 by bolts or the like, the opening area of the oil path 80 at the compression chamber 43 side can be kept constant, so that the amount of oil to be injected into the compression chamber 43 can be set to the design amount.

In this embodiment, the hermetically sealed rotary compressor 200B is equipped with one cylinder 41. However, the present invention is not limited to this embodiment, and the present invention may be applied to a hermetically sealed rotary compressor having two or more cylinders.

Figure 16:
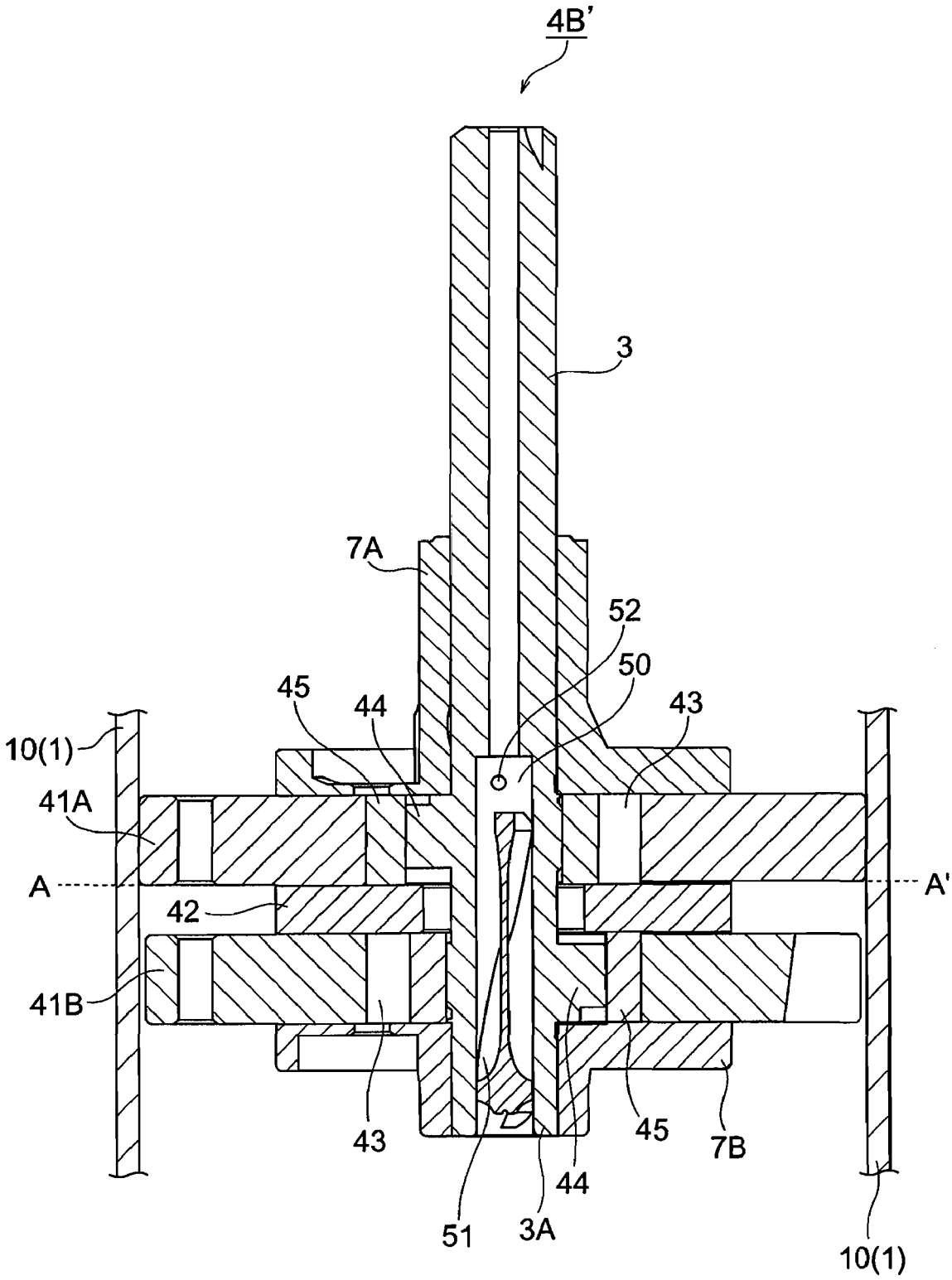
FIG. 16 is a diagram showing a modification of the third embodiment of the present invention.
Figure 17:
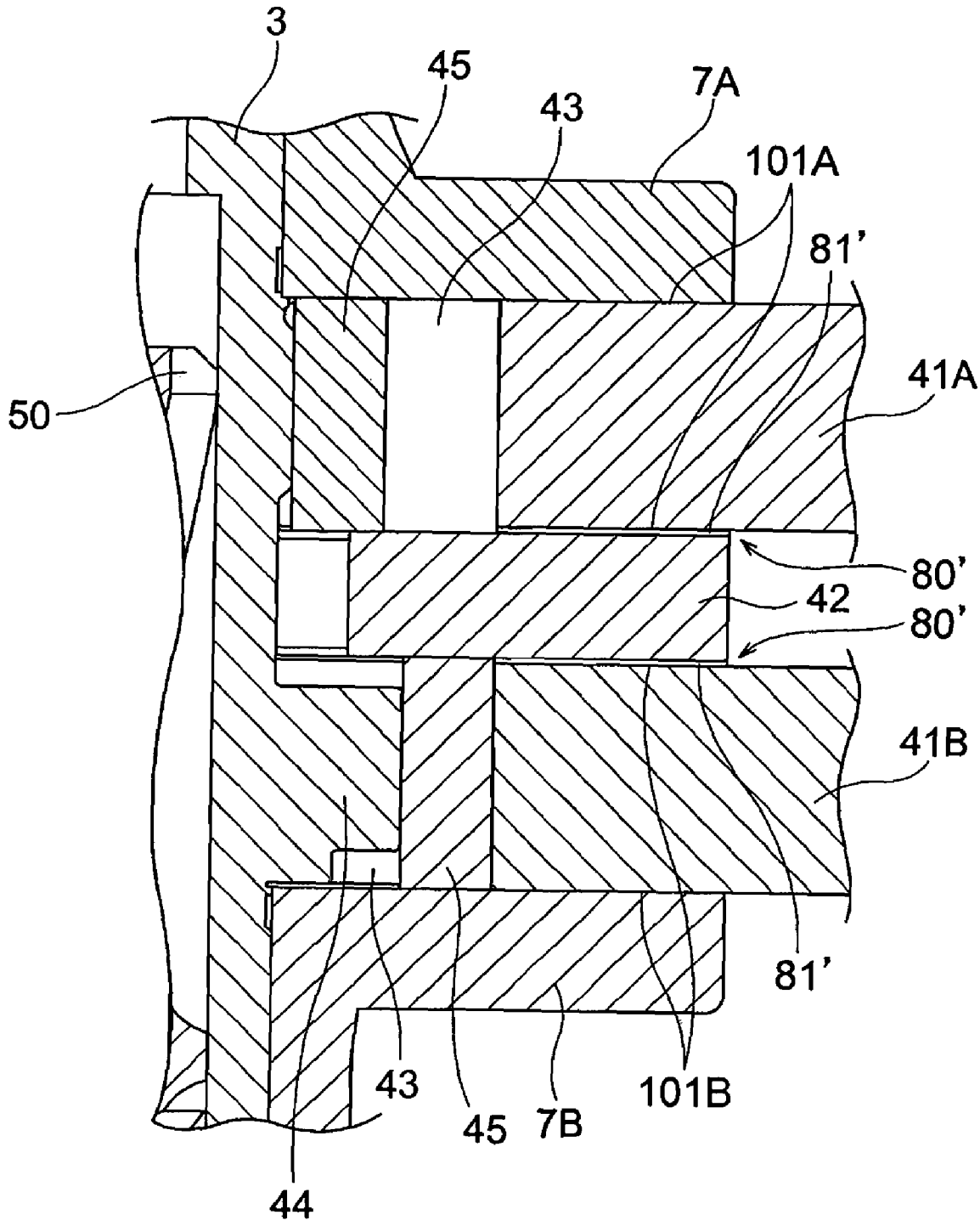
FIG. 17 is an enlarged longitudinally-sectional view showing an oil path.

Specifically, in a hermetically sealed rotary compressor having two cylinders, as shown in FIGS. 16 and 17, a rotary compressing element 4B' is designed so that the cylinders 41A and 41B are disposed in the vertical direction between the primary bearing 7A and the secondary bearing 7B so as to sandwich the partition plate 42 therebetween, the upper-side opening face of the cylinder 41A at the upper stage is closed by the primary bearing 7A while the lower-side opening face thereof is closed by the partition plate 42, and the lower-side opening face of the cylinder 41B at the lower stage is closed by the secondary bearing 7B while the upper-side opening face thereof is closed by the partition plate 42, thereby forming the compression chamber 43 in each of the cylinders 41A, 41B. In the rotary compressing element 4B', the primary bearing 7A or the cylinder 41A at the upper stage (the cylinder 41A in FIGS. 16 and 17) is welded and fixed to the hermetically sealed container 1, and immersed in the oil 8 stocked in the hermetically sealed container 1.

As shown in FIG. 17, in the rotary compressing element 4B', step portions 101A are formed within the contact faces with the primary bearing 7A and the partition plate 42 on the upper and lower surfaces of the cylinder 41A at the upper stage to enhance the close contact between the cylinder 41A and each of the primary bearing 7A and the partition plate 42, and also step portions 101B are formed within the contact faces with the secondary bearing 7B and the partition plate 42 on the upper and lower surfaces of the cylinder 41B at the lower stage to enhance the close contact between the cylinder 41B and each of the secondary bearing 7B and the partition plate 42.

In the cylinder 41A at the upper stage, a groove 81' constituting an oil path 80' is formed on the lower surface of the cylinder 41A which is in contact with the partition plate 42, that is, on the lower-side step portion 101A. Furthermore, in the cylinder 41B at the lower stage, a groove 81' constituting an oil path 80' is formed on the upper surface of the cylinder 41B which is in contact with the partition plate 42, that is, on the upper-side step portion 101B. With this construction, the oil 8 is injected through each oil path 80' into the compression chamber 43 of each of the cylinders 41A, 41B during the refrigerant suction process, so that the sealing performance between the roller 45 and the cylinder 41A, 41B can be enhanced.

Fourth Embodiment

Next, a fourth embodiment according to the present invention will be described.

Figure 18:
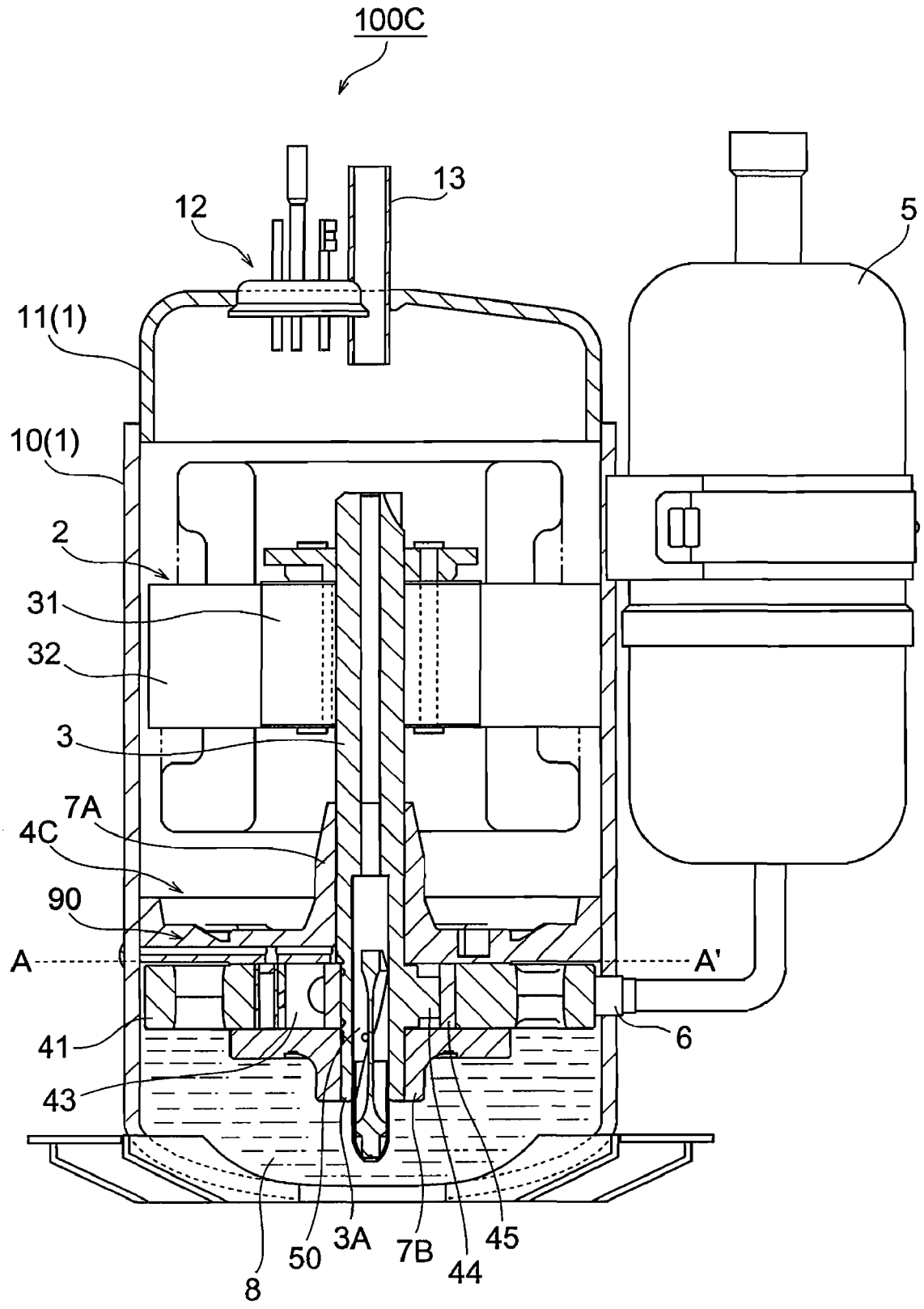
FIG. 18 is a longitudinally-sectional view showing the construction of a hermetically sealed rotary compressor according to a fourth embodiment of the present invention.
Figure 19:
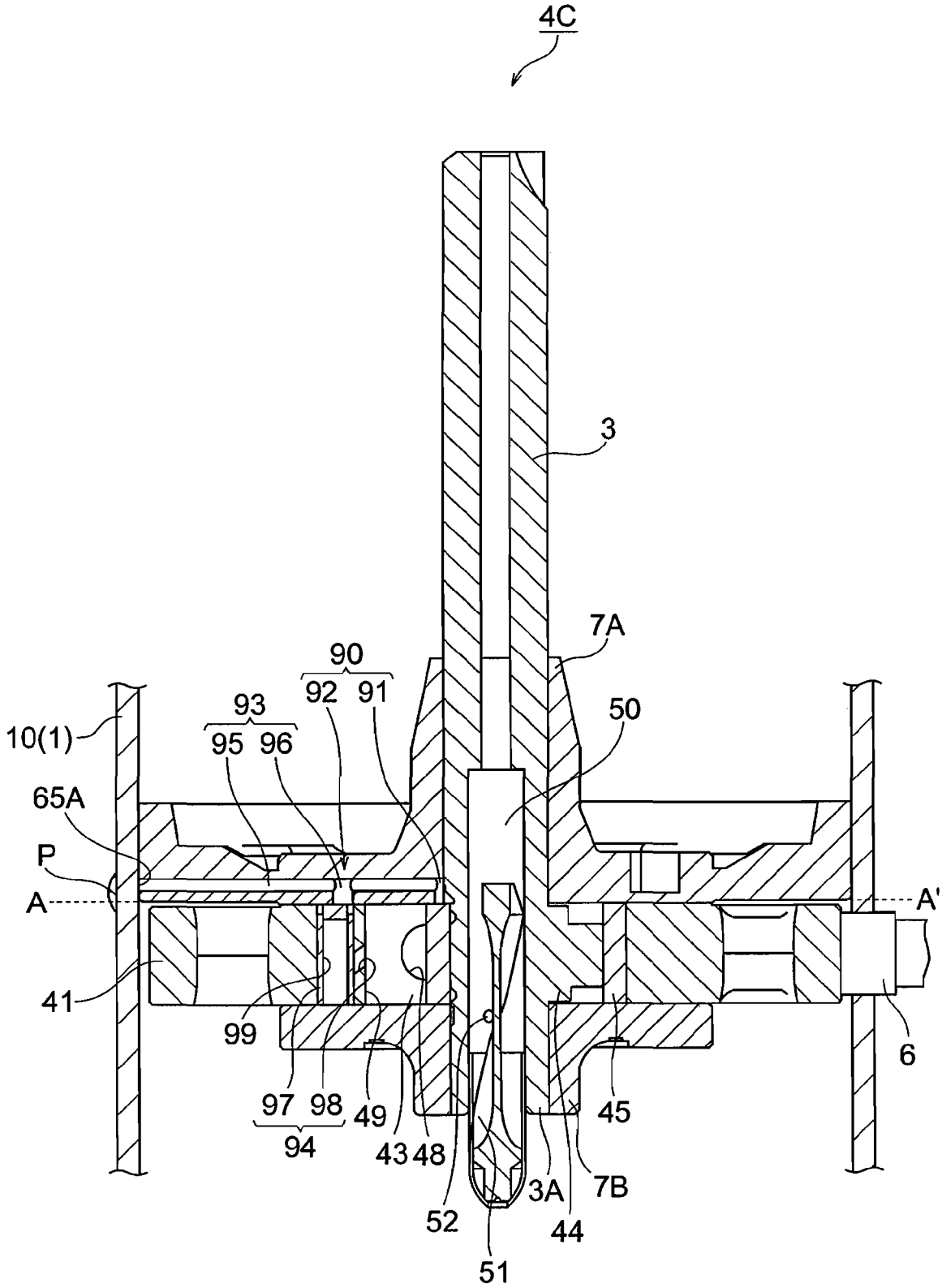
FIG. 19 is an enlarged longitudinally-sectional view showing a rotary compressing element.

FIG. 18 is a longitudinally-sectional view showing a hermetically sealed rotary compressor 100C according to a fourth embodiment of the present invention, and FIG. 19 is an enlarged longitudinally-sectional view showing a rotary compressing element. As shown in FIGS. 18 and 19, a hermetically sealed rotary compressor 100C of this embodiment is designed so that a rotary compressing element 4C is equipped with one cylinder 41 as in the case of the second and third embodiments, and the basic construction thereof is substantially the same as the second and third embodiments. Therefore, the same elements as the second and third embodiments are represented by the same reference numerals, and the description thereof is omitted.

Here, in order to enhance the refrigerant compression efficiency, the hermetically rotary compressor 100C of this embodiment is equipped with an oil injecting portion 90 for injecting the oil 8 into the compression chamber 43 when the refrigerant is sucked into the compression chamber 43. The construction of the oil injecting portion 90 will be described hereunder in detail.

As shown in FIG. 19, the oil injecting portion 90 comprises an oil stocking portion 91 that is provided in the primary bearing 7A to stock the oil 8, and an oil path 92 for injecting the oil 8 stocked in the oil stocking portion 91 to the compression chamber 43.

The oil stocking portion 91 is constructed by forming an annular space along the outer peripheral surface of the crank shaft 3 at the rubbing face of the primary bearing 7A against the crank shaft 3. Accordingly, when the oil pickup 50 supplies the oil 8 to each rubbing portion between the rotary compressing element 4C and the crank shaft 3, a part of the oil 8 is stocked in the oil stocking portion 91.

The oil path 92 comprises a secondary oil path 93 formed in the primary bearing 7A, and a primary oil path 94 formed in the cylinder 41 so as to intercommunicate with the secondary oil path 93. In more detail, the secondary oil path 93 comprises a first oil path 95 (through hole) penetrating from the outer peripheral surface of the primary bearing 7A to the oil stocking portion 91, and a second oil path 96 that is formed so as to extend from the lower surface of the primary bearing 7A in the upward direction (thickness direction) and intercommunicate with the first oil path 95. Accordingly, the oil 8 stocked in the oil stocking portion 91 is led through the first oil path 95 and the second oil path 96 to the primary oil path 94 of the cylinder 41.

When the primary bearing 7A is fixed to the hermetically sealed container 1 by conducting tack-welding from the outside of the hermetically sealed container 1, the place P corresponding to the opening end 95A of the first oil path 95 at the outer peripheral surface of the primary bearing 7A is tack-welded from the outside of the hermetically sealed container 1, whereby the opening end 95A can be brought into close contact with the inner surface of the hermetically sealed container 1 and closed by the inner surface of the hermetically sealed container 1 simultaneously with the fixing of the primary bearing 7A. Accordingly, the opening end 95A can be closed without separately using any member for closing the opening end 95A, so that the cost can be reduced and the fabrication work can be simplified. Furthermore, in the case of the construction that not the primary bearing 7A, but the cylinder 41 is fixed to the hermetically sealed container 1, the opening end 95A of the first oil path 95 is closed by using a plug or the like.

Figure 21:
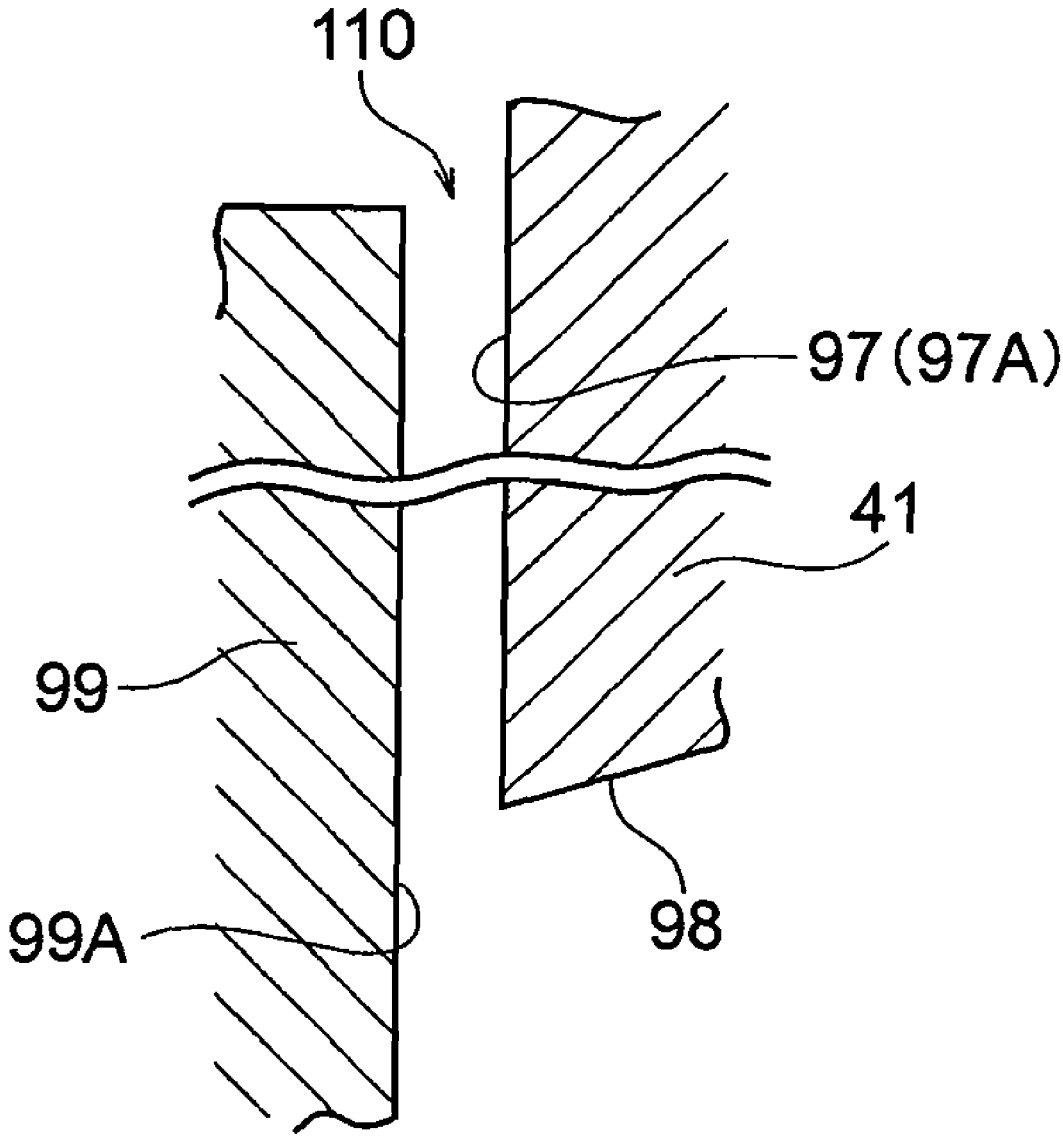
FIG. 21 is an enlarged longitudinally-sectional view showing clearance.

The primary oil path 94 comprises a cylindrical vertical hole 97 that penetrates through the cylinder 41 in the vertical direction (thickness direction) and is equal to about 4 to 5 mm in diameter, and an injection port 98 that intercommunicates with the vertical hole 97 and is opened to the inner surface 49 of the cylinder 47. A cylindrical fit-in piece 99 having a diameter which is slightly smaller than the diameter of the vertical hole 97 is loosely fitted in the vertical hole 97, and predetermined clearance 110 is formed between the peripheral surface 97A of the vertical hole 97 and the outer peripheral surface 99A of the fit-in piece 99 as shown in FIG. 21.

That is, the oil 8 led from the oil stocking portion 91 through the secondary oil path 93 to the primary oil path 94 is transmitted through the clearance 110 and then led from the injection port 98 to the compression chamber 43.

Here, the injection port 98 is opened to the cylinder inner surface 49 of the low-pressure chamber side 43A so that the oil 8 is injected into the compression chamber 43 during the suction of the refrigerant into the compression chamber 43.

Accordingly, since the refrigerant discharge pressure (for example, 3 MPa) is applied to the oil 8 in the hermetically sealed container 1, the high-pressure oil 8 stocked in the oil stocking portion 91 is passed through the oil path 92 comprising the secondary oil path 93 and the primary oil path 94 into the low-pressure chamber side 43A of the compression chamber 43 of the cylinder 41 by the differential pressure of the oil 8 from the inner pressure (for example, 1.1 MPa) of the low-pressure chamber side 43A of the compression chamber 43 during the suction process of sucking the refrigerant into the compression chamber 43.

As described above, the oil 0 is injected into the compression chamber 43 during the refrigerant suction process, so that sufficient oil film is formed between the cylinder inner surface 49 and the roller 45 by the oil 8 thus injected and the sealing performance is enhanced. As a result, in the compression chamber 43 of the cylinder 41, the low-pressure chamber side 43A and the high-pressure chamber side 43B are more surely separated from each other. Therefore, in the process (compression process) that the refrigerant sucked in the low-pressure chamber side 43A is compressed in the high-pressure chamber side 43B, the compressed refrigerant is prevented from leaking into the low-pressure chamber side 43A, and the refrigerant compression efficiency is enhanced, so that the cooling efficiency of the hermetically sealed rotary compressor 100 is enhanced.

Figure 20:
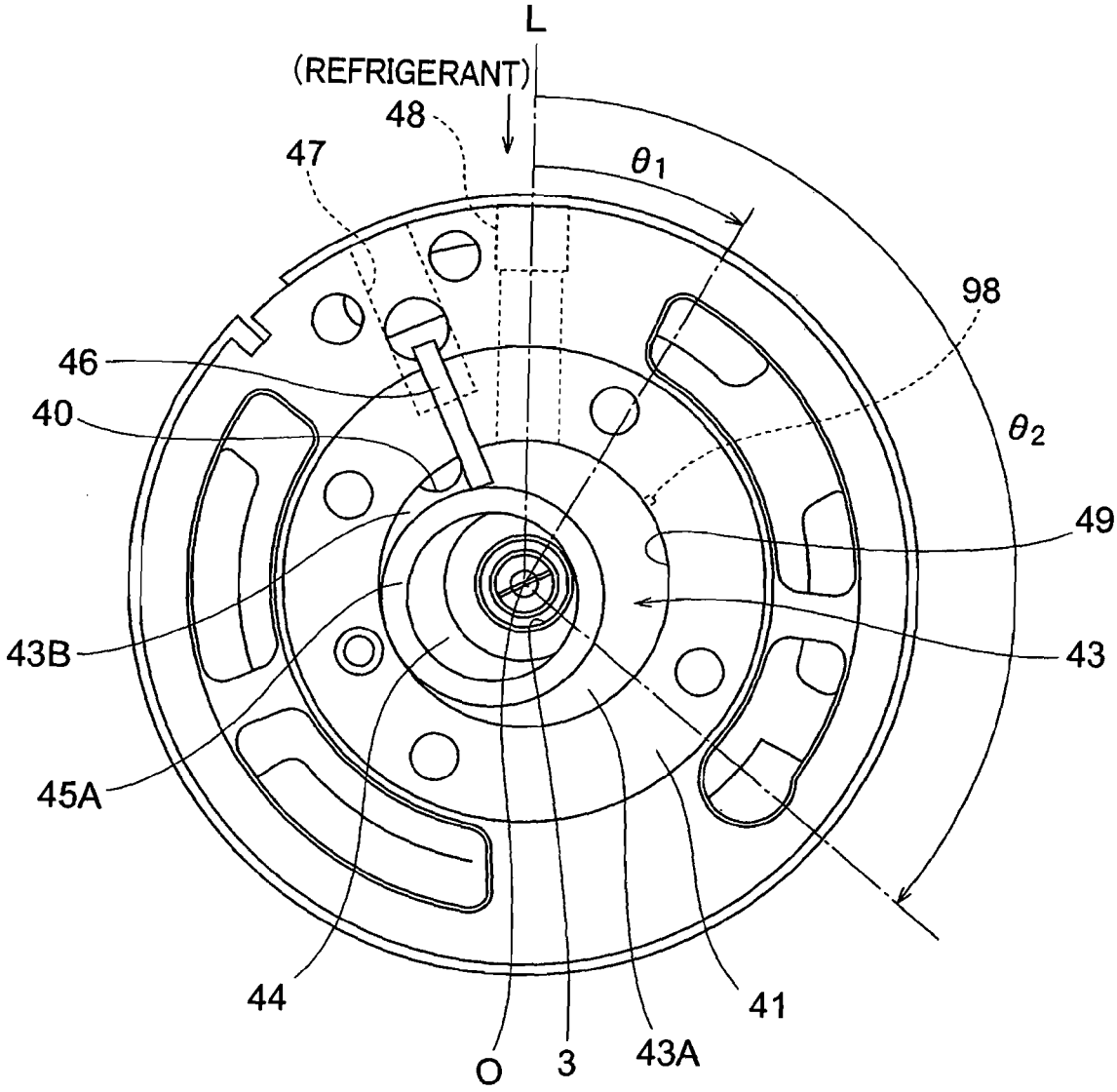
FIG. 20 is a plan view showing a cylinder.

As shown in FIG. 20, the injection port 98 is formed to be opened at an angle in the range from θ1 to θ2 (θ1: 0°, θ2: 170°, more preferably (θ1: 125°, θ2: 165°) with reference to a reference line L connecting the suction port 48 and the center point O of the cylinder 41 (about 125° in FIG. 20).

Here, the amount of the oil 8 injected into the compression chamber 43 during the refrigerant suction process is adjustable by adjusting the size of the clearance 110 between the vertical hole 97 and the fit-in piece 99. In this embodiment, in order to set the amount of the oil 8 injected to the compression chamber 43 to the optimal amount, the size of the clearance 110 is determined so that the ratio R between the size of the clearance 110 and the displacement volume V of the compression chamber 43 falls within a predetermined range.

Specifically, when the ratio R is excessively small, the clearance 110 is excessively narrow, and no oil 8 is injected into the compression chamber 43. Conversely, when the ratio R is excessively large, the oil 8 is excessively injected into the compression chamber 43, and liquid compression occurs. Therefore, according to this embodiment, when the displacement volume V of the compression chamber 43 is equal to 5 to 5.5 cc, the clearance 110 is set to about 10 μm to 30 μm, whereby the sealing performance between the cylinder inner surface 49 and the roller 45 is enhanced with preventing liquid compression due to excessive injection of the oil 8.

As described above, according to this embodiment, as in the case of the first to third embodiments, the oil 8 is injected into the compression chamber 43 during the suction process of the refrigerant into the compression chamber 43. Therefore, the sufficient oil film is formed between the cylinder 41 and the roller 45 by the oil 8 injected in the compression chamber 43 and the sealing performance is enhanced. Accordingly, the refrigerant under the compression process is prevented from leaking into the low-pressure chamber side 43A, and the compression efficiency is enhanced, so that the cooling efficiency of the hermetically sealed rotary compressor 100C can be enhanced.

Furthermore, according to this embodiment, the oil path 92 is constructed by the vertical hole 97 penetrating through the cylinder 41 in the vertical direction and intercommunicating with the secondary oil path 93, and the injection port 98 opened to the inner surface 49 of the cylinder 41 so as to intercommunicate with the vertical hole 97. Furthermore, the fit-in piece 99 is loosely fitted in the vertical hole 97 so that the clearance is provided between the vertical hole 97 and the fit-in piece 99, and the amount of the oil injected into the compression chamber 43 is adjustable by changing the size of the clearance. Therefore, the oil amount can be simply adjusted by changing the size of the fit-in piece 99.

Furthermore, according to this embodiment, the clearance is adjusted in accordance with the displacement volume V of the compression chamber 43, and thus only the amount of the oil with which the liquid compression caused by the excessive injection of the oil 8 can be prevented and also the sealing performance between the cylinder inner surface 49 and the roller 45A can be enhanced can be injected into the compression chamber 43.

In this embodiment, the hermetically sealed rotary compressor 100C is equipped with one cylinder 41. However, the present invention is not limited to this embodiment, and the present invention may be applied to a hermetically sealed rotary compressor having two or more cylinders.

What is claimed is:

1. A hermetically sealed compressor for compressing refrigerant, comprising:

a rotary compressing element including at least two cylinders, each cylinder having a compression chamber for compressing the refrigerant and a roller that is provided in the cylinder so as to be freely eccentrically rotatable;

an electrically-driven element for driving the roller;

a hermetically sealed container for accommodating the rotary compressing element and the electrically-driven element therein, oil being stocked in the hermetically sealed container;

an oil supply device for supplying oil stocked in the hermetically sealed container to a rubbing portion between the electrically-driven element and the rotary compressing element;

an oil stocking portion disposed between the cylinders and proximate the rubbing portion; and an oil path for leading the oil supplied from the oil stocking portion to the compression chamber in connection with a suction of refrigerant into the compression chamber of the cylinder.

2. The hermetically sealed compressor according to claim 1, wherein the cross-section area of the oil path is determined so that a ratio between the cross-section area of the oil path and the displacement volume of the compression chamber is between 0.004 to 0.030 $mm^2/cc$.

3. The hermetically sealed compressor according to claim 1, further comprising a plate-shaped member sandwiched by the cylinders.

4. The hermetically sealed compressor according to claim 3, wherein the oil path comprises a primary oil path including a groove formed into at least one of an upper and a lower surface of the cylinders and a secondary oil path extending from the oil stocking portion to the groove through the plate-shaped member.

5. The hermetically sealed compressor according to claim 1, wherein the oil supply device includes a spiral oil flow path, the oil supply device being integrally rotatable with the electrically-driven element such that the oil stocked in the hermetically sealed container is drawn upwards through the spiral flow path by the rotation of the electrically-driven element.

6. A hermetically sealed compressor for compressing refrigerant, comprising:

a rotary compressing element including at least two cylinders, each having a compression chamber for compressing the refrigerant and a roller that is provided in the cylinder so as to be freely eccentrically rotatable;

an electrically-driven element for driving the roller;

a hermetically sealed container for accommodating the rotary compressing element and the electrically-driven element therein, oil being stocked in the hermetically sealed container;

a primary oil path formed into the cylinder for supplying oil to a low-pressure side of the compression chamber in connection with the suction of the refrigerant into the compression chamber of the cylinder, wherein the ratio between the cross-section area of the oil path and the displacement volume of the compression chamber is between 0.004 to 0.030 $mm^2/cc$;

an oil supply device for supplying the oil stocked in the hermetically sealed container to a rubbing place between the electrically-driven element and the rotary compressing element;

an oil stocking portion that is disposed proximate the rubbing portion to stock the oil supplied from the oil supply device and to supply the oil to the primary oil path;

a plate-shaped member sandwiched by the cylinders; and a first oil path extending from the oil stocking portion to the primary oil path through the plate-shaped member.

7. The hermetically sealed compressor according to claim 6, wherein the oil supply device includes a spiral oil flow path, the oil supply device being integrally rotatable with the electrically-driven element such that the oil stocked in the hermetically sealed container is drawn upwards through the spiral flow path by the rotation of the electrically-driven element.

* * * * *